United States Patent [19]

Gremillet

[11] 3,944,042

[45] Mar. 16, 1976

[54] SYLLABIC TYPEWRITERS AND SIMILAR MACHINES

[76] Inventor: Jean Gremillet, 64 Avenue Felix Faure, Paris 15°, France

[22] Filed: Aug. 30, 1974

[21] Appl. No.: 502,188

Related U.S. Application Data

[63] Continuation of Ser. No. 259,051, June 2, 1972, abandoned.

[30] Foreign Application Priority Data

June 21, 1971 France ..... 71.22540

[52] U.S. Cl. ..... 197/7; 197/9; 197/98

[51] Int. Cl.[2] ..... B41J 3/02

[58] Field of Search ..... 197/7, 9, 98, 1 A; 178/21, 178/17 C

[56] References Cited

UNITED STATES PATENTS 3,073,427 1/1963 Gremillet ..... 197/7

3,225,883 12/1965 Ayres ..... 197/9 X

*Primary Examiner*—Edgar S. Burr
*Assistant Examiner*—R. T. Rader
*Attorney, Agent, or Firm*—Robert E. Burns; Emmanuel J. Lobato; Bruce L. Adams

[57] ABSTRACT

A syllabic keyboard and the devices through which its keys control different mechanisms and/or apparatus, for example : printers and/or other recording systems. The material structure of the keyboard, these devices and their arrangements have made possible different layouts of syllabic keyboards for different languages in which certain keys each control simultaneously up to five characters plus a spacing. Several character keys and spacing keys may be depressed simultaneously.

11 Claims, 21 Drawing Figures

304
305
635
634
150
633
638
636
632
150
742
790
745
806
805
837
780
779
707
768
NIII-TIV-SV
796
795
797
798
799
722
800
802
788
804
785
NIII-TIV
794
793
735
729
752
722
725
761
765
738
770
762
764
774
706
708
750
740
NIII
791
792
704
767
767
782
781
703
756
789
754
755
786
784
798
797
799
722
TIV
TS
800
802
788
752
RS
702
787
706
803
709
786
784
801
883
743

Fig.6a
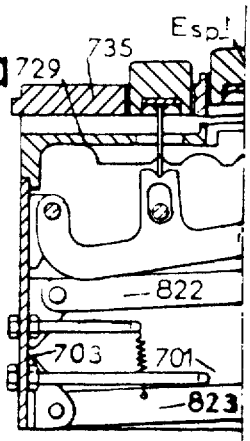
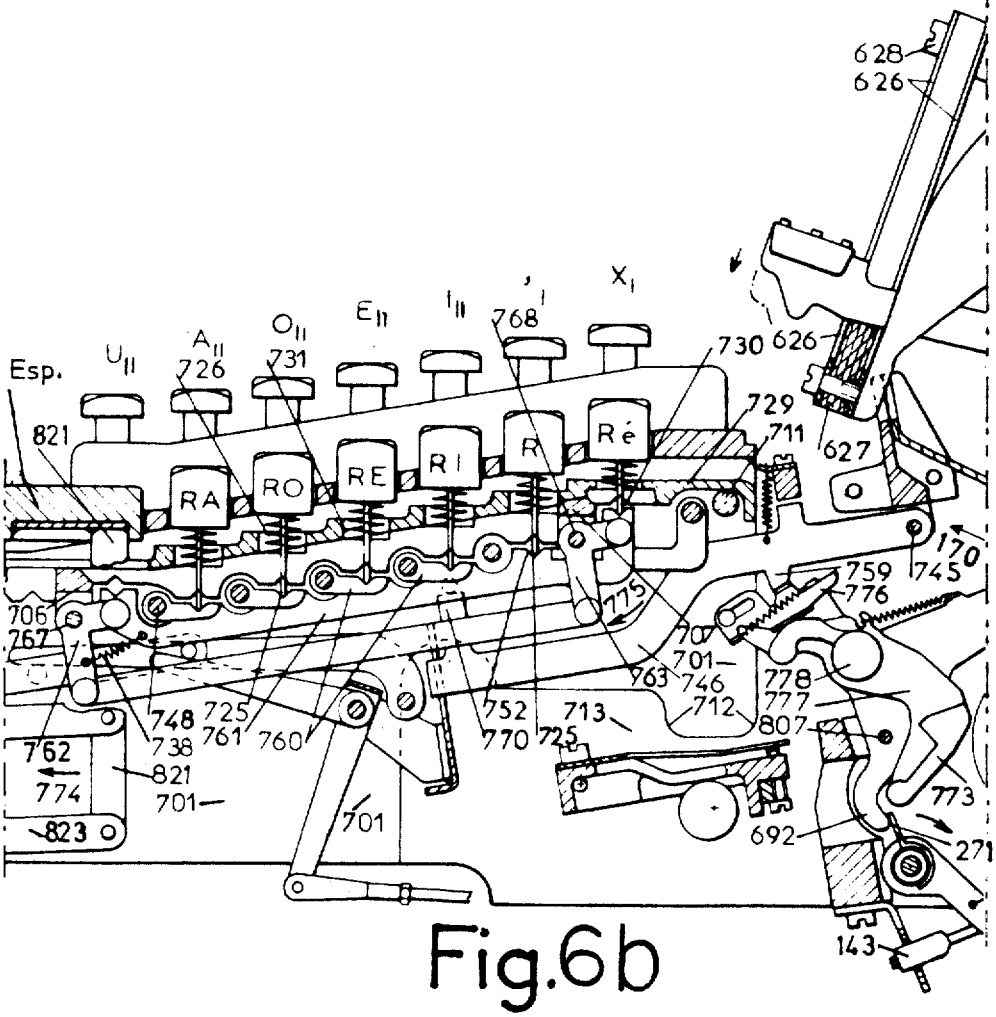
Fig.6b

SYLLABIC TYPEWRITERS AND SIMILAR MACHINES

CROSS-REFERENCES TO RELATED APPLICATIONS

This application is a continuation of my application Ser. No. 259,051 filed June 2, 1972, now abandoned.

Divisional Applications of the present application:

Ser. No. 502,190 concerning a shift mechanism for syllabic typewriters,

Ser. No. 502,192 concerning an escapement mechanism for syllabic typewriters and for advancing a magnetic or punched tape, Ser. No. 502,184 concerning syllabic-keyboard controlled devices which comprise a storage unit.

BACKGROUND OF THE INVENTION

1. Field of the Invention

Syllabic-keyboard controlled devices, for example: that utilized in Graphic Arts, syllabic typewriters and other recording devices.

2. Description of the Prior Art

A syllabic typewriter has already been proposed by the U.S. Pat. No. 3,073,427 Gremillet.

SUMMARY OF THE INVENTION

In a first embodiment, a syllabic keyboard similar to that of U.S. Pat. No. 3,073,427 controls a syllabic printing mechanism through mechanical devices. These mechanical devices, which constitute the material structure of the keyboard and their prolongations, comprise different improvements, for example:

key-rods, particular parallelograms, transverse counter-motion devices, an arrangement of these elements, which constitutes a mechanical rectangular matrix.

The Disclosure describes a combination of this syllabic keyboard with these devices in a complete syllabic typewriter.

In a second embodiment, the syllabic keyboard comprises keyboard switches which are supported by a plate on which may be printed electric circuits to which the keyboard switches are connected.

These circuits are prolonged to the devices that the keys have to control.

These devices may be, for example, the several parts and mechanisms of a syllabic typewriter that are provided with electromagnets. The electromagnets control directly certain of these devices, such as the escapement mechanism, or engage each a cam on a driving cylinder to transmit the movement to other of these devices, for example, to each type bar.

In those cases the typewriter comprises a syllabic printing mechanism. Such a typewriter is shown in the dravings and is partially described.

The syllabic switch-keyboard may control non syllabic devices through a storage unit; for example:

a non syllabic printer such as that of a non syllabic typewriter, a device for permanent or semi-permanent storage which utilises any memory medium, for example: punched or magnetic tapes or cards, and which may control a recording system later.

The syllabic switch-keyboard may be utilized as a peripheral device of a computer.

The syllabic switch-keyboard presents different improvements, for example:

differences in level between certain keys, particular relative localizations of certain key families, arrangements of switches and electromagnets.

The material structure of these keyboards and these different improvements have made possible different layouts, for example-:

layouts for different languages and bilingual keyboards.

In these layouts certain keys may control simultaneously up to five characters plus a spacing.

Several character keys and a spacing key may be depressed simultaneously.

A device with a commutator permits to change the character assignments to certain keys.

The Disclosure describes the combination of these syllabic switch-keyboards and of the different devices in a complete syllabic typewriter.

GENERAL CONSIDERATIONS

In the embodiments presented for a complete syllabic typewriter, the power of a smooth motor-driven cylinder is employed for printing and for different associated functions, as well as intermediary levers and other elements normally used in non-syllabic electric typewriters.

The machine described may evidently be adapted so as to employ similar elements borrowed from electric typewriters of another type. For example, a grooved motor-driven cylinder and levers similar to those normally used in such cases could be employed.

The associated devices, such as those for back-spacing, for return of the carriage, for tabulation and for advancement of the ribbon, which are well-known and which undergo no modification in this invention, are neither described nor illustrated.

Different parts of the machine that do not form part of the invention are shown only schematically and insofar as is necessary to situate the new devices or make their connections with the latter understandable.

Thus it is, for example, with the motor, the motor-driven cylinder, type-bars and certain electronic components.

In the first example of realization described hereafter, it is presumed that the keyboard is similar to that described in U.S. Pat. No. 3,073,427.

Figure 1:
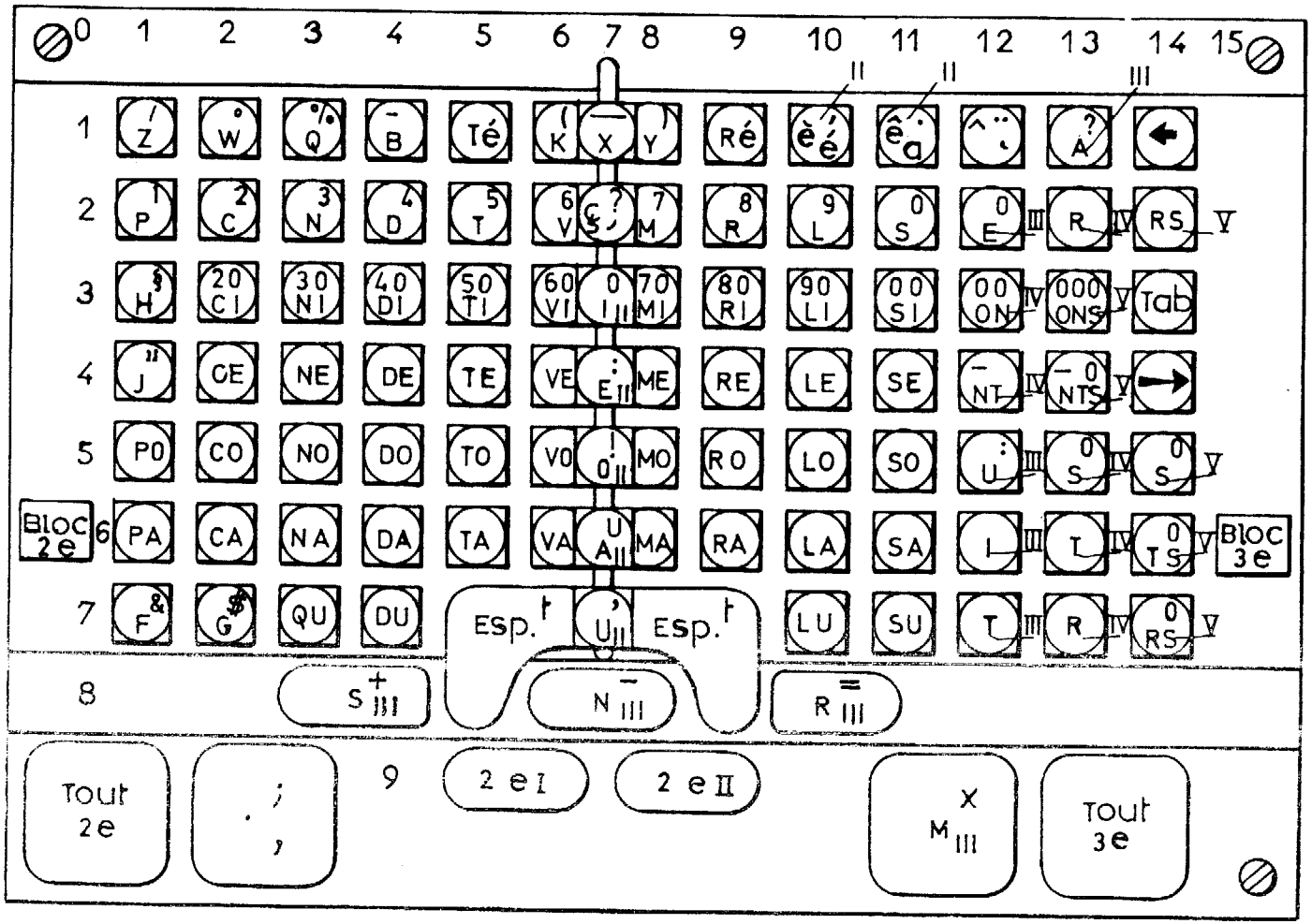
FIG. 1. Keyboard of the type that allows the use of only mechanical connections. Layout for the French language. Top view.

FIG. 1 will recall the structure and layout of this keyboard.

In a second embodiment, the machine is provided with electro-magnets. Electrical and electronic connections then replace numerous mechanical connections, giving greater freedom for the layout of the keyboard.

FIG. 1 is an example of a keyboard that may be adopted when the connections are solely mechanical, and also when they are electrical and electronic.

Figure 8:
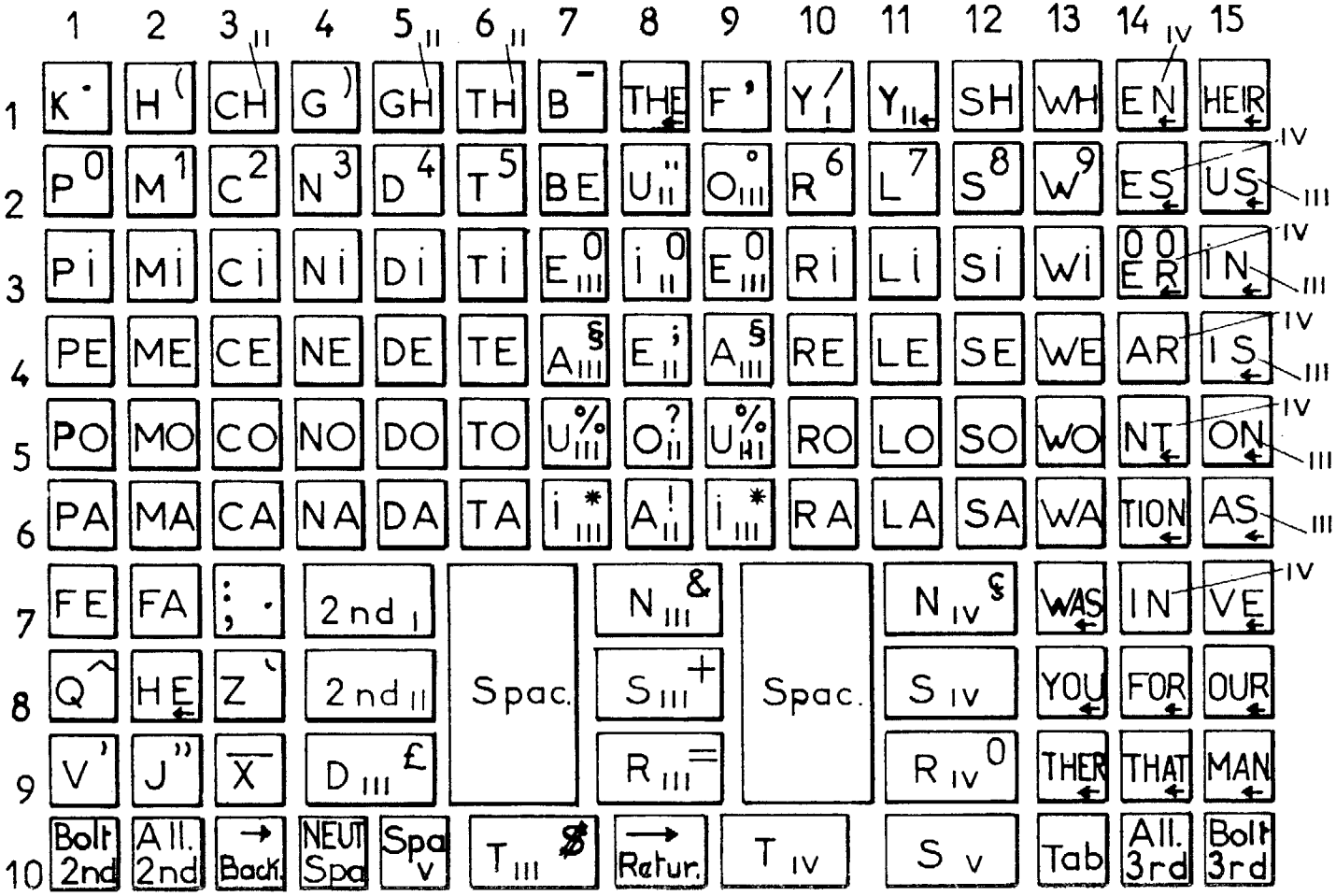
FIG. 8. Switchboard. Example of a layout for the English language.

FIG. 8 shows a type of keyboard that can only be adopted when the machine is furnished with electro-magnets. This keyboard includes, among other features, keys for large combinations ("that", "heir", "tions", etc.) that enable, at the depression of a single key, the printing of up to four characters at a time, and the simultaneous production of the space that has to follow them. On the other hand, numerous keys corresponding to Groups III and IV ($^{E}$III, $^{N}$III, $^{T}$IV) are situated at the centre of the keyboard to facilitate fingering.

DESCRIPTION OF THE STRIKING MECHANISM

First will be described the complete embodiment the connections by which the keys produce the engagements and the connections for control of the escapement are purely mechanical. Then will be described the modifications in which these connections are electromagnetic and electronic.

Figure 2:
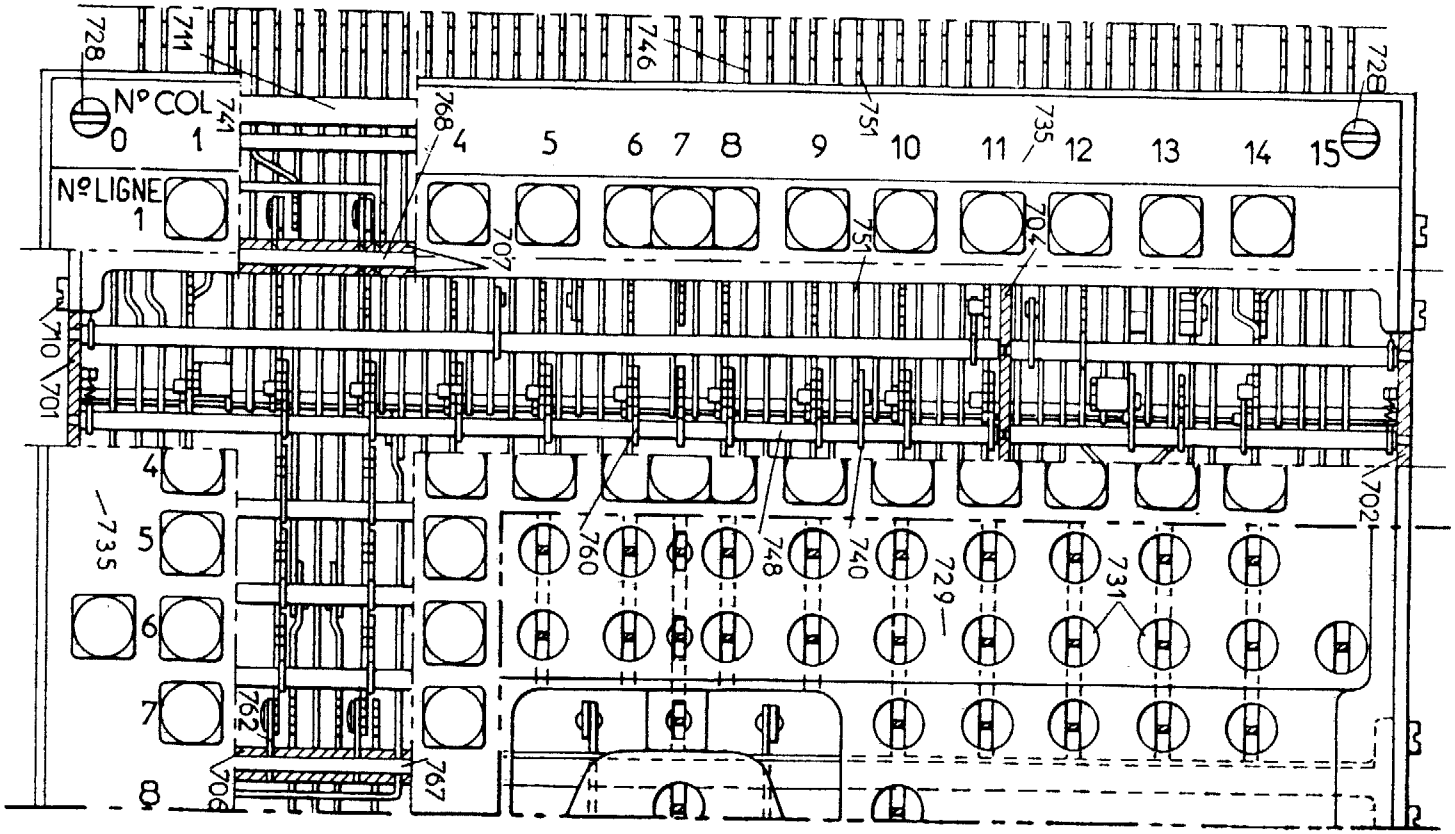
FIG. 2 Part of the mechanical connection box superimposed on the longitudinal levers, the keyboard being partly removed to show the articulated parallelograms combined with the devices for transverse deflecting of the movement (counter-motion device). Top view.

The keyboard shown in FIG. 1 is based on a connection-box. The latter is situated above the forward part of the longitudinal levers (FIG. 2). The keyboard (FIG. 1) is laid out for the French language. The connections and mechanisms remain the same for other languages.

KEYS AND KEY-RODS

Figure 3:
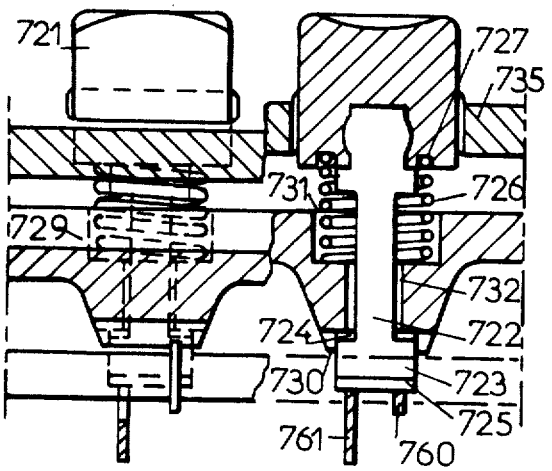
FIG. 3. Two keys each with its double-angular-edge knife, simultaneously driving a parallelogram that corresponds to the column and a transverse countermotion device corresponding to the row. Front view.

The normal character-keys 721 (FIG. 3 and 6) are each mounted on a key-rod 722 whose lower part is made up of a double-edged knife 723. The upper edge

724 of this knife is held by return spring 726 of the key against the bottom of an angular groove 730 presented by the under surface of a support-plate 729 for the keys. The lower part of the spring 726 is located in a circular hole 731 in this plate. The upper part is engaged in a circular groove 727 situated in the lower face of the key 721. The spring holds the key and returns it into rest position when it has been depressed. The upper edge of the knife limits the rise of the key by impinging against the top of the angular groove 730. The key-rod 722 is held vertical. The key is situated in a square hole in a screen 735, which limits its horizontal movements, but the hole is a little larger than the horizontal cross-section of the key and, theoretically, this latter does not therefore rub against the support-plate.

Figure 5A:
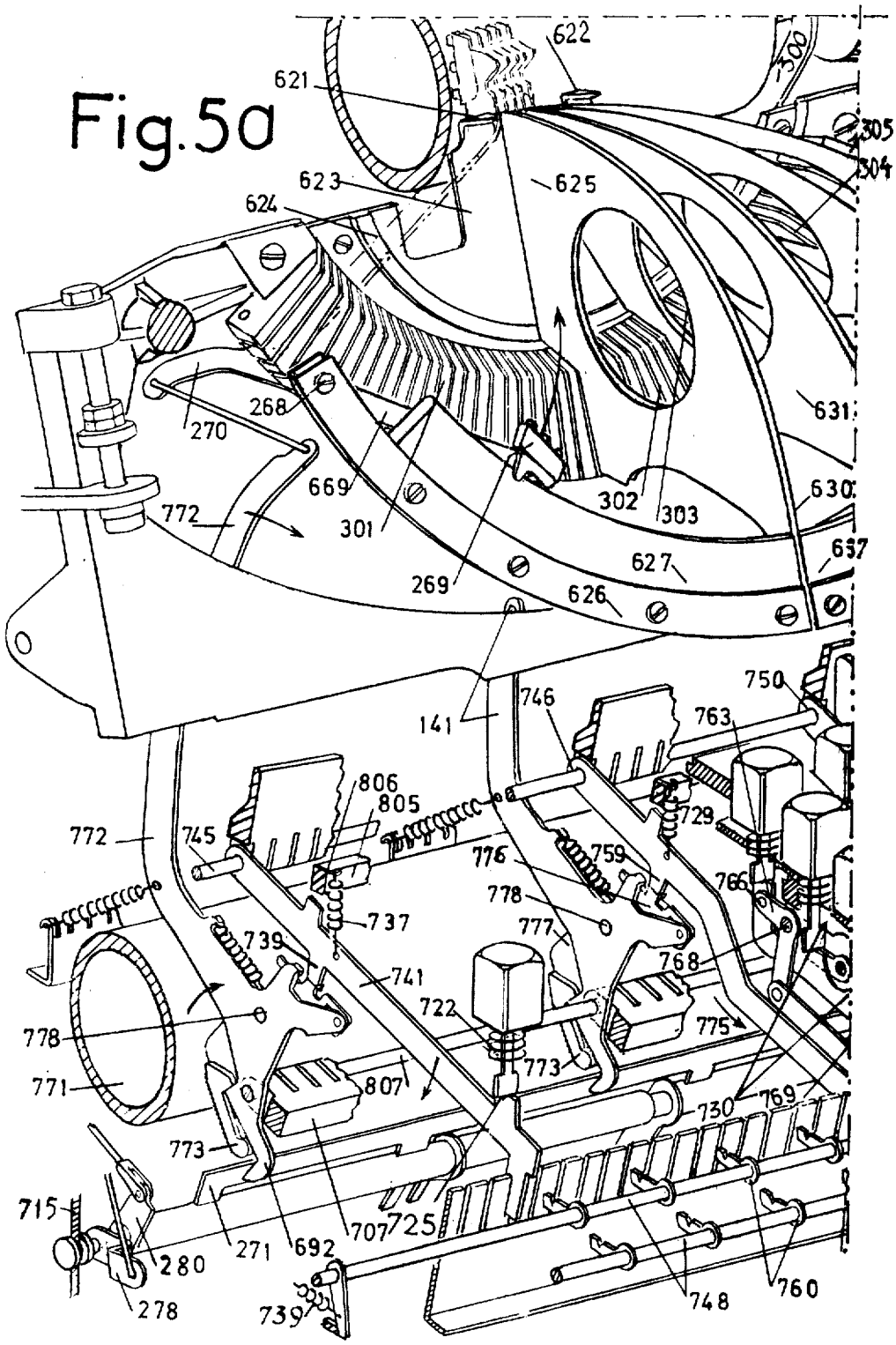
FIG. 5. comprising parts designated 5*a*, 5*b*, 5*c*. Printing mechanism. Partial view, in perspective.
Figures 5B, 5C:
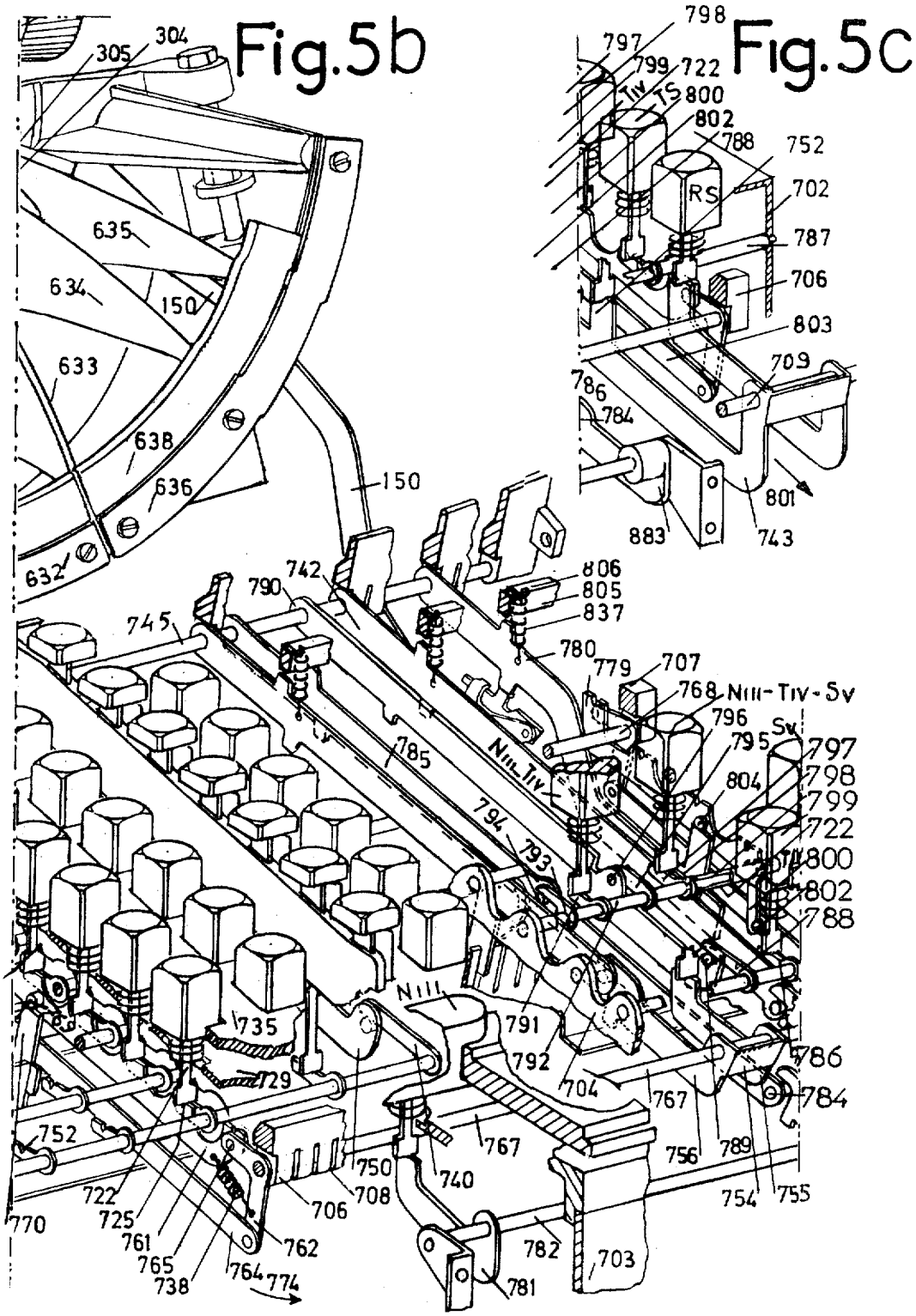

The lower edge 725 of the knife 723 is situated at the bottom of an angular notch 752 set in the lever or in each of the levers or in the upper connecting-rod of an articulated parallelogram that the key must operate. Certain keys each control several levers or connecting-rods. Each of these parts, such as the radial lever 760 of a counter-motion device (FIGS. 6 and 5) and the upper connecting-rod of a parallelogram 761, is drawn upwards by a return spring. Each of these parts thus pushes the knife 723. This pressure contributes to the retaining of the key-rod in its vertical position.

GENERAL DESCRIPTION OF THE LONGITUDINAL LEVERS

Levers such as 741, 746, 742 and 780 in FIG. 5 are called longitudinal levers. The keys are not fixed to these levers.

These longitudinal levers are shown in part from above in FIG. 2. They all have a common axle 745 (FIG. 5). Certain of them 741 take the movement of a single rod 722 directly. Others 746, separately take the movement of several keys situated in the same column of the keyboard, which act, each in its turn and through its key-rod, on an articulated parallelogram (FIGS. 6 and 5) which is common to them and which will be described.

Each longitudinal lever is drawn upwards by drawback spring 737. When the connection-box is fixed to the machine, each longitudinal lever butts against the lower knife or knives 725 of the key-rods that act on it or against a snug 769 borne by the upper connecting-rod of the articulated parallelogram that control it.

When the keyboard, which is removable, or the whole connection-box are taken away, all the longitudinal levers butt against a cross-bar 805 fixed at right and left to the framework of the machine. This cross-bar bears a tongued plate 806, the springs 737 of the longitudinal levers being hooked on to the tongues.

Certain longitudinal levers 750 (FIG. 5) are each operated by several keys, "ce,ne,de,te,ve,e,me,re,-le,se" (FIG. 1) of the same row, which act each in turn on the same counter-motion device that includes an axle 748 that bears small radial levers 760.

The longitudinal levers such as 741, 746, 742 and 780, each of which corresponds to one or several character-keys, have each for its function to engage on a motor-driven cylinder 771 (FIG. 5 and 6) a cam 773 that transmits the movement to an intermediate lever 772. Each of these intermediate levers effects: printing by means of a type-bar 267; the raising of the ribbon and its forward movement; also the escapement that allows the forward movement of the carriage. At the engagement of each cam 773, printing takes place by known means, but several cams are engaged simultaneously, which is new.

Escapement is effected by an entirely new device. The longitudinal levers 741 (FIG. 5) directly operated by a key-rod 722, each presents an angular notch 752 at the point where the lower of the rod drives it. For certain keys, "IV" or "III", each of which displaced laterally in relation to the longitudinal lever on which it has to act, 790 or 785, the connection-box includes a transverse counter-motion device, made up of an axle 782 bearing two radial levers of which one 781 is driven by a key-rod, while the other 783 acts on a snug such as 784 with which the longitudinal lever 785 is provided. A suitable relationship between the length of a reversed lever such as 783 and the corresponding longitudinal lever such as 785 ensures the uniformity of the necessary displacements of the keys of the different rows of the keyboard so as to obtain equal angular displacements of the different longitudinal levers.

DESCRIPTION OF THE ARTICULATED PARALLELOGRAMS THAT EACH CONTROL A LONGITUDINAL LEVER

When several keys "té" to "ta" in the same column of the keyboard (FIG. 1) control the same longitudinal lever 746, the uniformity of the angular movements of this lever is obtained by using an articulated parallelogram that is set in motion by each of the rods of these keys. This principle is well-known in itself, but the present invention makes use of articulated parallelograms having a new structure.

The keys "ré" to "ra" (FIG. 1) in the 9th column, or "té" to "ta" in the 5th column, transmit, each in turn, by the lower angular edges of the knives 725 (FIGS. 5 and 6) of their respective rods, their movement to a connecting-rod 761, called the "upper connecting-rod of the parallelogram". This connecting-rod has as many angular notches 752 as there are keys that have to act on it. It is articulated on two bell-crank levers 762 and 763 by the axles 765 and 766. Each of these bell-cranks is mounted on a common shaft, 767 for the front bell-crank 762, and 768 for the back bell-crank 763. These shafts are supported by the connection-box. They are common to all similar parallelograms. The other end of each of the two bell-cranks is articulated on one of the ends of a second connecting-rod 764 called the lower connecting-rod of the parallelogram. The upper connecting-rod 761 has a snug 769, which overhangs the upright 770 that constitutes the end of the corresponding longitudinal lever 746 Each parallelogram is furnished with a drawback spring 738.

WORKING

Whenever any one of the keys "té" to "ta", FIG. 5, is depressed, its key-rod 722 pushes the upper connecting-rod 761 of the parallelogram downwards, which causes the bell-cranks 762 and 763 to pivot in the direction of the direction-arrows 774 and 775. The lower connecting-rod 764 obliges the two bell-cranks to make the same angular displacement. The upper connecting-rod 761 can thus only descend parallelly to itself, whatever key may be struck. This connecting-rod, by its snug 769, draws down with it in its descent the corresponding longitudinal lever 746 and makes it pivot on the axle 745, and this movement is of the same amplitude whatever key is struck.

This longitudinal lever 746 (FIGS. 6 and 5) by its protuberance 759 draws down an anti-repetition sliding device 776 and the lever 777 that bears a cam 773, as do the longitudinal levers of other types. The component made up of the sliding device and the lever pivots on the axle 778, which puts the cam 773 in contact with the driving cylinder 771; as in a normal machine.

Such parallelogram levers are used in Group I to make up together with the counter-motion devices of Group II, the rectangular matrix that will be described later. Such longitudinal levers provided with an articulated parallelogram may be used in other Groups. One is used whose upper connecting-rod 779 (FIG. 5) controls the longitudinal lever 780 of Group V.

Compared with the parallelogram devices set out in U.S. Pat. No. 3,073,427, the devices described above do away with the overhang of the action of each of the keys relative to the position of the two axles that support the parallelogram. In effect, the key-rods act between the verticals of the two shafts 767 and 768, or very near one of them. In the device set out in U.S. Pat. No. 3,073,427, the two corresponding shafts were situated one above the other and most of the key-rods acted very far forward of them. As a result there was more intense friction on the shafts and less uniformity between the movements transmitted to the same lever by the different keys.

DESCRIPTION OF THE TRANSVERSE COUNTER-MOTION DEVICES OF GROUP II.

When several keys "ce,ne,de,te,ve,e,me,re,le,se" (FIG. 1) situated in the same row of the keyboard but in different columns have each separately to operate the same longitudinal lever, a transverse counter-motion device is employed comprising a shaft such as 748 in FIG. 2 for the 3rd row, or in FIG. 5 for the 5th and 6th rows. This shaft carries as many radial levers such as 760 as there are keys that have to act on the device. Each shaft 748 carries in addition a radial lever 740 that operates the corresponding longitudinal lever such as 751 or 750. Such counter-motion devices are mainly used to act on the longitudinal levers of Group II so as to make up, by their combination with the articulated parallelograms of Group I, the matrix comprising combination keys that each simultaneously operate a character of Group I and one of Group II.

In comparison with counter-motion devices previously proposed, which were each made up of a swinging frame, the devices described above have the advantage of being able to be placed and to function within the thickness occupied by the whole ensemble of longitudinal levers and articulated parallelograms. This reduces the thickness of the ensemble and the length of the key-rods.

RECTANGULAR MATRIX MADE UP OF THE COMBINATION KEYS THAT EACH SIMULTANEOUSLY OPERATE TWO TYPE-BARS, ONE IN GROUP I AND ONE IN GROUP II

In the machine here described, this matrix presents individual features consisting of the form of the parallelograms and of the counter-motion devices, of the key-rods with knives and of the supporting parts that the connection-box comprises.

In the example, this matrix corresponds to the same keys as in U.S. Pat. No. 3,073,427. They are the character-keys included (FIG. 1) within the rectangle h, si, su, f, with the exception of the keys h, f and g.

In this matrix, the radial levers such as 760 (FIGS. 2, 5 and 6) are of the same length as the upper arm of the bell-cranks such as 762 and 763 included in the articulated parallelograms that operate the longitudinal levers. As a result, each knife such as 723 (FIGS. 4 and 3) of a key-rod 722, which acts at the same time on an upper connecting-rod 761 of a parallelogram and on one of the radial levers in question 760, undergoes no friction, the bottom of the notch borne by the connecting-rod 761 and the bottom of the notch borne by the radial lever 760 making exactly the same movement when the knife presses on them simultaneously. Such knives thus act as the knives of balances, although each acts simultaneously on two parts. Besides, the direction of the knife thus remains the same during the stroke, and the key does not tend to pivot on itself.

In the matrix described, each of the keys that are at the intersection of a column provided with an articulated parallelogram and of a row provided with a counter-motion device, causes simultaneously the printing of the character in Group I that corresponds to the column and the printing of the character in Group II that corresponds to the row.

EXAMPLE OF COMBINATION KEYS, ONE OF WHICH OPERATING THREE TYPE-BARS SIMULTANEOUSLY

The upper connecting-rod 779 (FIG. 5) of the articulated parallelogram of Group V is actuated by several keys in the 13th column. This parallelogram corresponds to the single type-bar $^{S}$V of Group V. This allows the disposal in the keyboard, FIG. 1, of the following combination keys: a key $^{R}$IV - $^{S}$V; a key $^{O}$III-$^{N}$IV; a key $^{O}$III-$^{N}$IV-$^{S}$V; a key $^{N}$III-$^{T}$IV-$^{S}$V; a key $^{T}$IV-$^{S}$V and a second key $^{R}$IV-$^{S}$V. On the other hand there is a thumb-key that corresponds to the letter N of Group III. FIG. 5 shows how, by applying the means already described, one may thus have the disposal of the keys $^{N}$III-$^{T}$IV and $^{N}$III-$^{T}$IV-$^{S}$V. This latter key actuates three type-bars simultaneously.

The key $^{N}$III (FIG. 5) controls the radial lever 781 fixed to the shaft 782. This shaft bears a reversed lever 783 which, by pressing on the snug 784, controls the longitudinal lever 785 corresponding to $^{N}$III. The key $^{N}$III thus only actuates the type-bar bearing the N of Group III.

The key $^{T}$IV drives the radial lever 786 fixed on the shaft 787. This shaft bears a second lever 788 which, by pressing on the snug 789, actuates the longitudinal lever 790 that corresponds to the character $^{T}$IV. This key, therefore, only prints the letter T of Group IV.

The key $^{N}$III-$^{T}$IV actuates the radial lever 791 borne by the shaft 792 and thus makes this shaft pivot. The latter has a second radial lever 793 which, by pressure on the snug 794 borne by the longitudinal lever 785 corresponding to $^{N}$III, effects the printing of that letter. But besides that, the shaft 792 bears a third radial lever 795 which, by pressure on the snug 796 borne by the longitudinal lever 790, produces the printing of $^{T}$IV. This key, therefore, simultaneously produces the printing of two letters $^{N}$III and $^{T}$IV.

The key $^{N}$III-$^{T}$IV-$^{S}$V actuates a fourth radial lever 797 borne by the shaft 792. But the knife comprised in the rod of this key NTS acts at the same time on a radial lever 798 fixed on a tube 799 that is mounted free on the shaft 792. This tube bears a second lever 800, which is placed vertically and pushes, in the direction of the arrow 801, on the snug 802 borne by the lower connecting-rod 803 of the parallelogram corresponding to the letter S of group V, which causes the upper connecting-rod 779 of this parallelogram to descend. The latter has a snug 804 that presses on the longitudinal lever 780 corresponding to the type-bar that bears the letter S of Group V. The key NTS thus sets the three longitudinal levers 785, 790 and 780 in motion, and thus produces the printing of the three corresponding letters N T S.

REMOVABLE MECHANICAL CONNECTION-BOX

The connection-box (FIGS. 2, 6 and 5) contains and supports the keys with their rods, the counter-motion devices and the reversed levers. Its structure is made up of a left plate 701, a right plate 702 and a front plate 703. At the back, a rear rod 711 maintains the distance between the plates 701 and 702. Between these plates, two supports 706 and 707 are fixed to these plates by the screws 710. In these supports are the shafts 767 and 768 common to the front 762 and back 763 bell-cranks of the articulated parallelograms corresponding to the columns of keys. The shafts 767 and 768 also serve as axles for various counter-motion devices such as 754 (FIG. 5).

Each of these two supports 706 and 707 present slots 708 for the passage and guiding of the bell-cranks such as 762 and 763 and for the other levers mounted on the shafts 767 and 768 (FIGS. 2 and 5).

A rod 709 (FIG. 5) is also fixed on the side plates 701 and 702, and serves as an axle for various levers such as 743 and for various transverse counter-motion devices.

A longitudinal partition 704 (FIGS. 2 and 5) is fixed on the front plate 703 and on the rear rod 711. On its left side this partition supports the shafts such as 748 (FIG. 5) whose other ends are supported by the left plate 701. The partition 704 also supports the various shafts such as 787 and 792 whose other ends are supported by the right plate 702.

The connection-box includes the support-plate 729 (FIGS. 2 and 3) which supports each key by its spring. This plate is shown in (FIG. 6), with its grooves 730 and the holes whose upper part 731 (FIG. 3) is cylindrical and whose lower part 732 is rectangular.

The connection-box includes a screen 735 (FIG. 2) with holes each having the shape of a key.

When the keys, their rods and their supports have been placed on the support-plate 729, the screen 735 is fixed on this plate by screws such as 728, FIG. 2. This whole then constitutes a removable keyboard that is fixed on the plates 701 and 702 of the box by screws that are not shown.

The lower edge 712 of the left plate 701 (FIG. 6) and that of the right plate 702, which is identical, have a shape designed to correspond with the edge of the front part of the two sides of the main frame of the machine. The connection-box being assembled, together with the parts that it contains and supports, is thus inserted and fixed in place so that its left 701 and right 702 plates complete the left and right sides 713 of the framework of the machine, to which it is attached by screws not shown. Thus it can be put in place and removed quite easily.

The longitudinal levers such as 741, 746, 742 and 780, FIG. 5, are made free to pivot on the framework of the machine through their common axle 745 and their return springs 737, which draw them against the inferior angular edges 725 of the knives of the key-rods when the connection-box is in place. When this box is removed, the longitudinal levers stop against the cross-bar 805.

The articulated parallelograms, the counter-motion devices, as well as the reversed levers, form part of the connection-box and are thus removed with it.

KEYS AND KEY-RODS CONTROLLING SUBSIDIARY FUNCTIONS

The back-spacing device is the same as that in ordinary electric typewriters. It will not be described here.

The keys that change the case position, "2eI" (2nd I) and "2eII" (2nd II), are set up in the same way as the type keys. The rods of the keys "Tout 2e" (all in 2nd) and "Tout 3e" all in 3rd are each mounted on an articulated parallelogram. The support-plate 729 (FIG. 6) does not thus support these keys.

At the places corresponding to these keys, the support-plate 729 has grooves allowing the removal of the assemble made up by this plate and the screen 735, without dismounting the keys in question.

The key operating the tabulator mechanism, "Tab", appears in FIG. 1 in order to complete the keyboard. The corresponding devices are identical with those used in ordinary typewriters. They will not be described here.

SHIFT MECHANISM

The machine includes five groups of type-bars, borne by the five sectors 301 to 305 (FIG. 5).

Each type-bar has three characters placed one above the other, the characters forming these three cases. For them to be printed therefore, the sectors must be able to occupy, relative to the carriage cylinder, three different positions: the 1st for small letters; the 2nd for capital letters; and the 3rd for figures, various signs and special characters.

ENGAGEMENT OF THE CAMS ON THE DRIVING CYLINDER BY MEANS OF ELECTROMAGNETS

Figure 4:
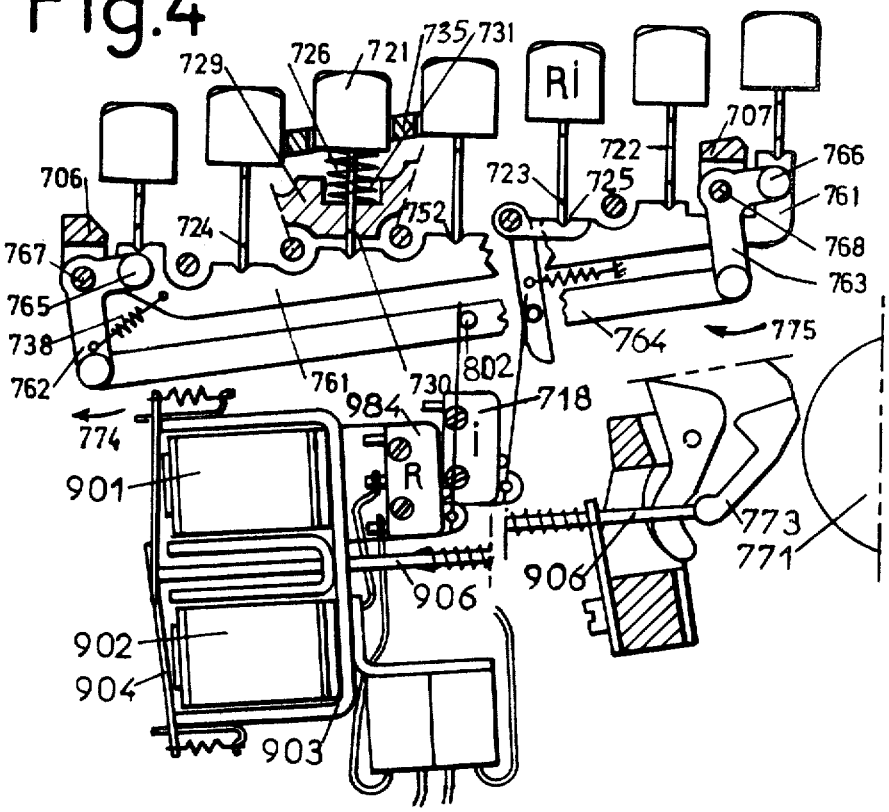
FIG. 4. One of the articulated parallelograms, the keys that actuate it, one of the counter-motion devices, and engaging electromagnets. View front the right side.
Figure 6C:
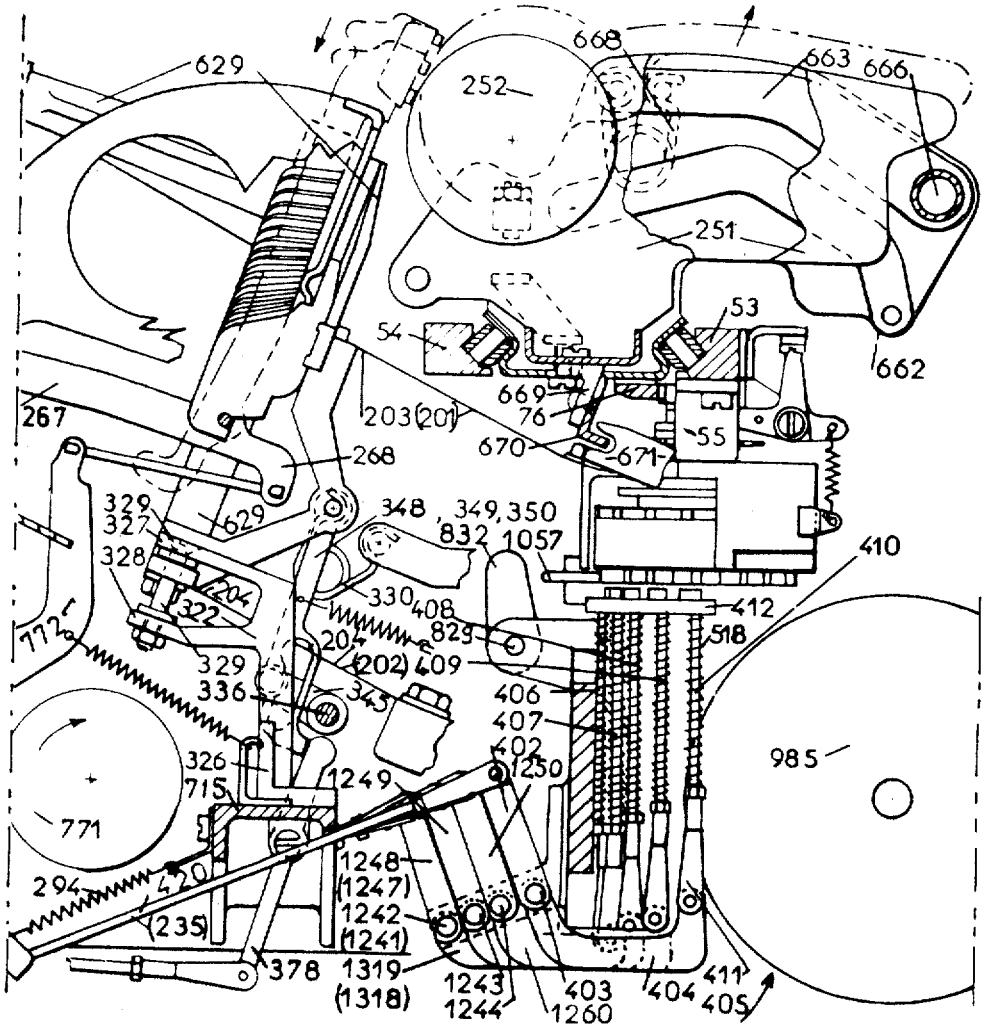
FIG. 6. comprising parts designated 6*a*, 6*b*, 6*c*. Escapement mechanism and printing mechanism. Longitudinal section, seen from the right.

The machine can comprise electromagnets of a type already well-known and used in electric typewriters for controlling machines automatically or at a distance. FIG. 6 and 4 show that the space necessary has been reserved for electromagnets such as 901 and 902 with their support 903 and the parts through which they control the engagement of the cams by the mobile armature 904 and the rod 906.

It is well-known that when one of these electromagnets receives an electric impulse, its rod 906 moves, pushes the corresponding cam 773 and engages it on the driving cylinder 771. The result is the printing of the corresponding character and all the other effects that the movement of the intermediate lever 772 produces when the engagement is produced mechanically by a key, as it has been described.

In the present variant, an electromagnet is also used as in certain electric typewriters activated at a distance to control each of the auxiliary functions such as the back space and the return of the carriage. These other electromagnets are not shown.

In the embodiment described here, the machine comprises a keyboard of the type shown in FIG. 1. When one strikes character keys or spacing keys, the mechanical connections that have been described engage the cams on the driving cylinder 771 as if there were no electromagnets. But when the printing is activated automatically by means of a buffer storage device, or at a distance the machine described enables several electromagnets to be put into circuit simultaneously and thus the printing of several characters simultaneously, with or without spaces.

It is this multiplicity of type-bars actuated simultaneously with or without action on the anchor to produce spacing, that is the essential characteristic of this use of electromagnets of a well-known type.

The devices combined with the machine to actuate it by punched cards or by magnetic tapes are well known. These will not be described.

When this machine must control another identical machine at a distance, one causes the lower end 692 of each intermediate lever to act on a contact switch to convey an electric impulse to the corresponding electromagnet of the second machine which is actuated at a distance. The syllabic typing is thus preserved as many intermediate levers switch on simultaneously several electromagnets of the second machine, either directly or through a memory.

In this case also the essential characteristic of the combination consists in that several electromagnets are switched on simultaneously in the two linked machines such that several characters are printed simultaneously with or without spacing.

In every case of automatic or remote control, the impulses produced simultaneously could be sent through separate wires or else coded and sent in series of impulses through a single wire. These series of impulses are automatically decoded in the second machine by a traditional decoding matrix.

When the machine is controlled by a "memory unit", the simultaneousness of the printing in several groups of characters and of spaces allows greater increase in speed than in the case of normal typing.

THE SWITCHING ON OF AN ELECTROMAGNET BY EACH OF THE ARTICULATED PARALLELOGRAMS AND BY EACH OF THE COUNTERMOTION DEVICES WHICH COMPOSE THE MATRIX THAT THE KEYBOARD COMPRISES

When the machine comprises articulated parallelograms each controlled mechanically by several keys in the same column (FIG. 4) and when on the other hand the machine is equipped with electromagnets such as 901 and 902 in order to assure the engagement of the cams 773 on the driving cylinder 771, one can eleminate the longitudinal lever 746 (FIG. 6) corresponding to each of these parallelograms. To achieve this a micro-switch 984 (FIG. 4) is disposed so that its lever is on the path of movement of a snug 802 that the lower connecting rod 764 of the parallelogram bears. The snug, in pushing the lever, switches on the corresponding electromagnet 901 or 902. With keyboards of the type shown in FIG. 1, there are 11 similar cases.

A micro-switch 718 is also placed so that its lever is on the path of movement of each lever such as 740 (FIG. 5) borne by the shaft such as 748 (FIG. 5) of each of the corresponding transverse counter-motion devices combined with the parallelogram to constitute the matrix of the keyboard already described. One can thus eliminate the lever such as 740 and the longitudinal levers such as 750 (FIG. 5) corresponding to the corresponding Counter-motion devices.

Thus all the keys that make up the rectangular matrix control the switching on of the electromagnets for engagement such as 901 The machine equipped with a keyboard of switches which control the electromagnets for printing and spacing.

In ordinary electric typewriters equipped with electromagnets such as 901, 902 (FIG. 4), these electromagnets are used usually only for the remote or automatic control of the machine. In these usual machines, for manual typing, one conserves generally the longitudinal levers 746 (FIGS. 5 and 6) which each have one key and each control mechanically the engagement of a cam such as 773 on the smooth moving cylinder 771 or another part on a grooved cylinder. In these usual machines, this choice is due to the fact that the mechanical liaison between each key and the cam or another corresponding part to effect engagement on the driving cylinder can be very simple.

In the syllabic machine described the mechanical connections (FIG. 5) between each key and one or more cams 773 (FIG. 6) is more complex. The result is that when this machine is equipped with electromagnets, such as 901, 902 (FIG. 4) for remote or automatic control, it could seem advantageous to replace the mechanical connections by which the keys engage the cams on the driving cylinder, for example, the simple longitudinal levers or longitudinal levers with parallelogram, together with the transverse counter-motion devices by a keyboard of electric connections completed by electronic components. The striking of each key then produces one or more electric impulses that simultaneously activate one or more electromagnets to produce the printing of one or more characters simultaneously with or without spacing.

Syllabic writing is thus produced as when the keys control mechanically the engagements on the driving cylinder; this is the way in the first model realised.

Figure 12A:
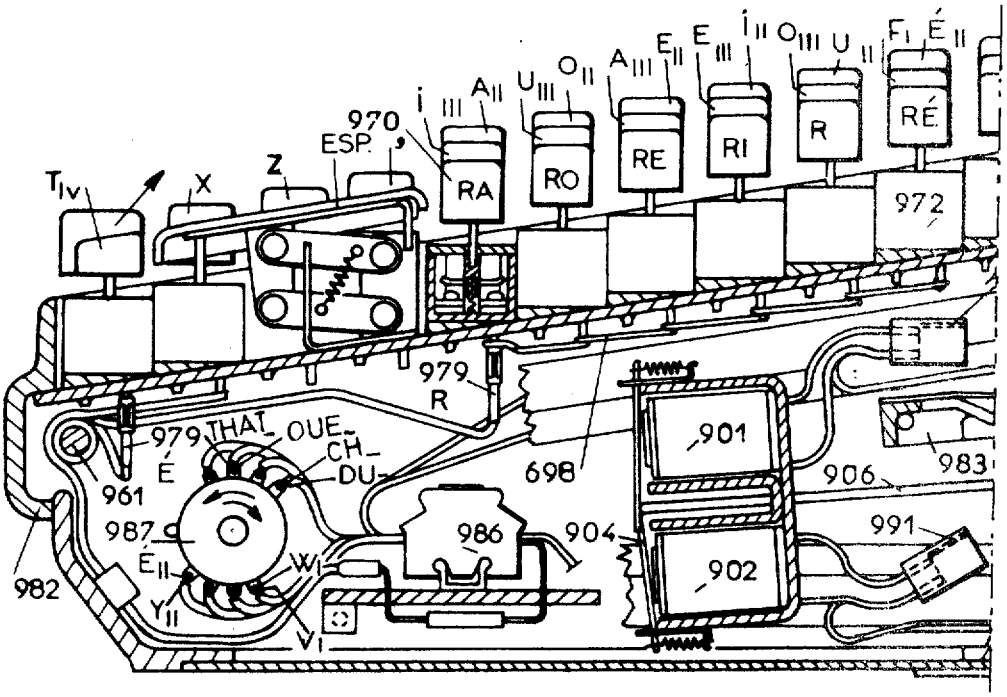
FIG. 12. comprising parts designated 12*a*, 12*b*, 12*c*. The whole machine in the version comprising a keyboard made up of switches that actuate the engagements on the driving cylinder and the escapement mechanism by electromagnetic means. Longitudinal section seen from the right.
Figure 12B:
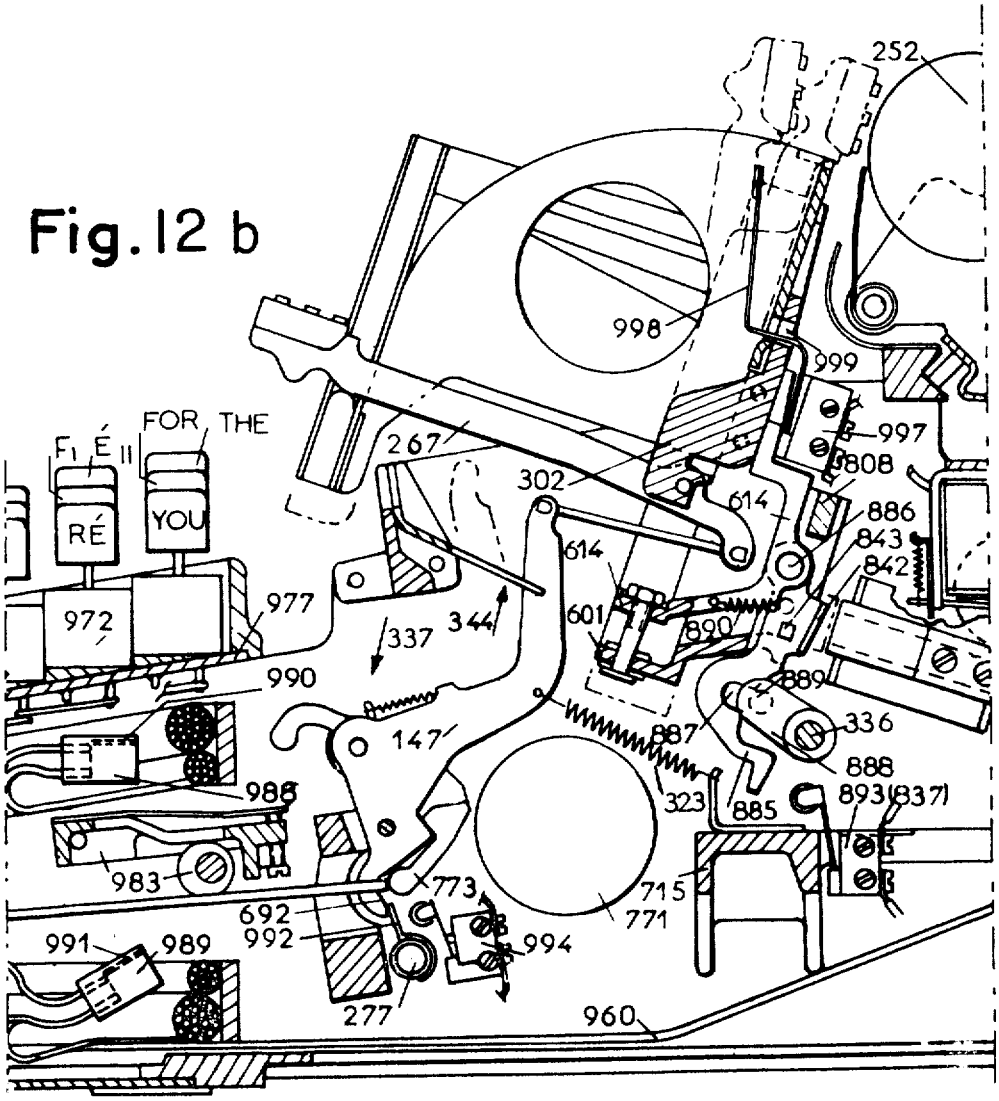
Figure 12C:
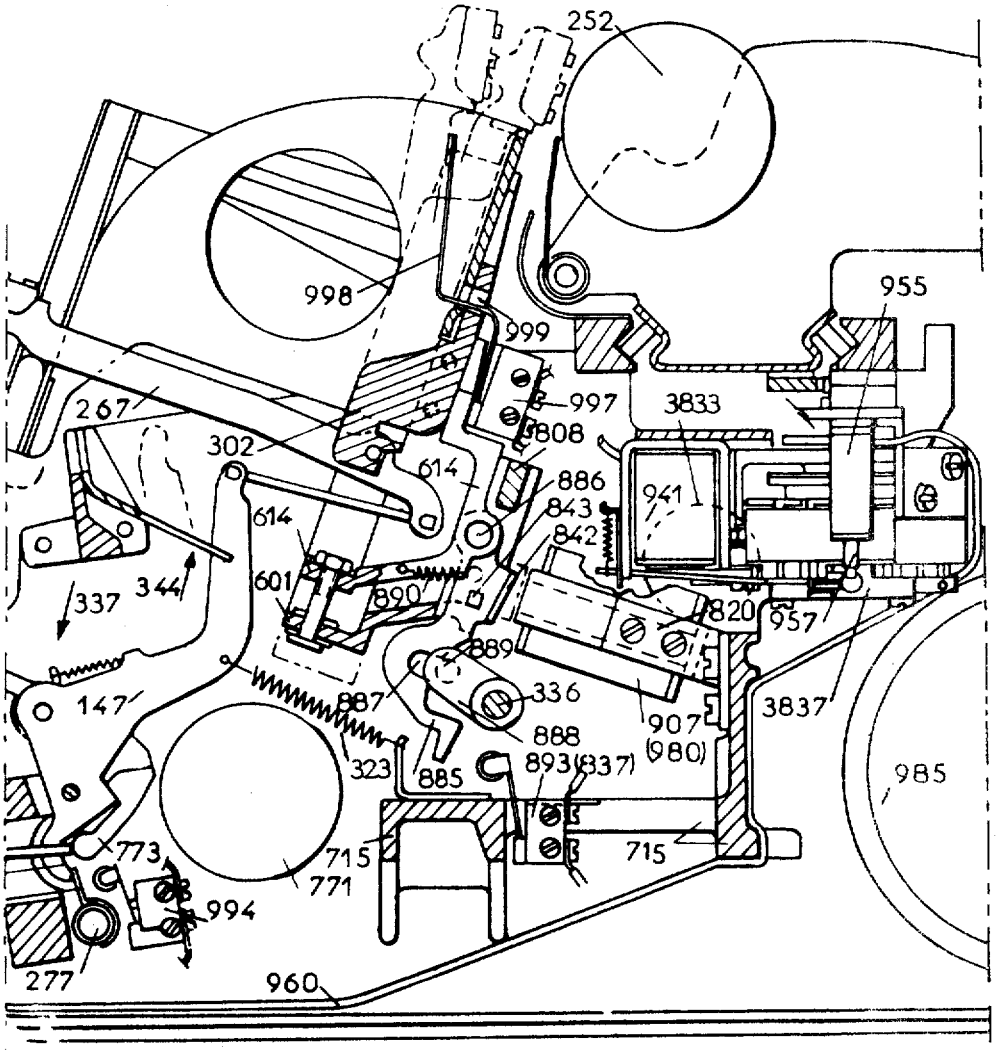

The machine equipped with such a keyboard of electric switches is shown (FIG. 12). It consists of a network of electric links: printed circuits and wires.

The principal advantages achieved by a keyboard of electric switches controlling electromagnets:

Simplification of mechanical construction.

Reduction of the force necessary to depress keys.

Uniformity of this force for all keys.

Greater ease in locating each key on the syllabic keyboard.

The possibility of simultaneously controlling with the same key a great number of letters together with spacing.

The possibility to obtain control of the escape mechanism with the help of electromagnets which in certain cases are switched on by a character key.

Certain of these advantages will now be detailed.

In syllabic typewriters, where the keys mechanically control the on a driving cylinder mechanically, the majority of keys are each situated in the region of the keyboard where the corresponding longitudinal lever passes. However, in those machines that use a keyboard of the type shown in FIG. 1, in addition to the keys of the rectangular matrix which combine the letters of group I and II, some keys have been displaced in relation to their respective longitudinal levers. Thus the thumb keys located at the lower center of the keyboard corresponding to the letters R, N, S of group III, whose longitudinal levers are nonetheless inevitably on the right-hand side of the machine have been nevertheless located in the front center of the keyboard. But when one uses only mechanical connections it is impossible to increase much the number of displaced keys, in order to improve the fingering. On the contrary with a keyboard made up of switches and a network of electrical connections, one can arrange all the keys in such a manner as to suit and simplify fingering and also assign the same letter to several keys. Thus, for example, one can use a keyboard of the type shown in FIGS. 7 and 8. The keys of this keyboard are each made up of the push-button of a switch of well-known type shown in FIGS. 9 and 12. The depressing of each key closes two circuits and its release cuts them off. But one can use any other type of electric switch and especially those where the depression of the key causes an impulse without there being mechanical contact, either through a change in capacity of by displacing a magnetic field. These well-known devices will not be described.

Figure 7:
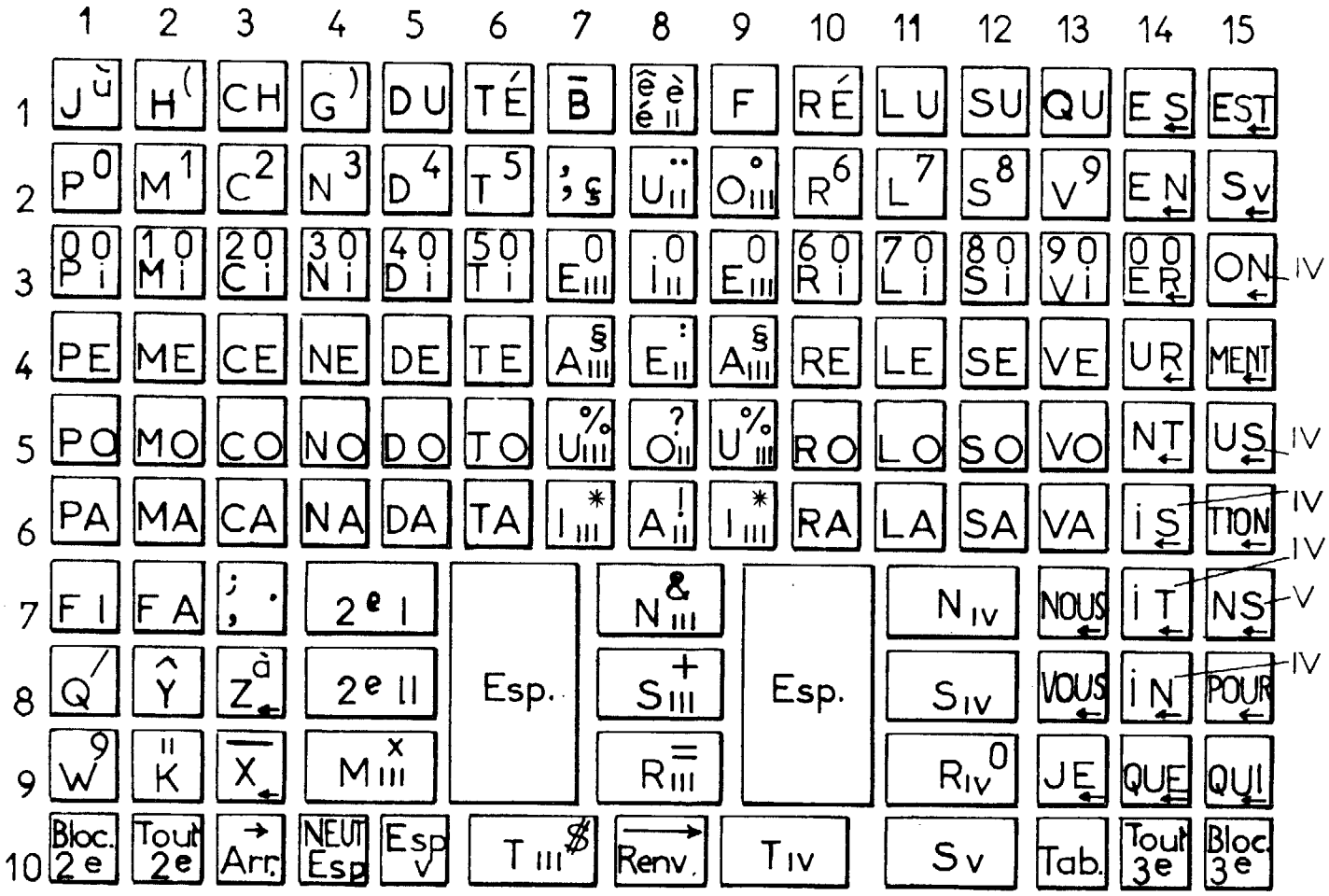
FIG. 7. Switchboard. Example of a layout for the French language.

Characteristics of the keyboard shown in FIGS. 7 and 8

On the keyboard shown in FIG. 7, the letters have been attributed to the different keys for the French language. Keyboards for other languages can be composed by applying the same principles and using the same means. Thus, for example the keyboard shown in FIG. 8 is made up for the English language, but its material construction is identical to that of the French keyboard (FIG. 7). The description that follows refers to the drawing FIG. 8.

The letters written on the keys correspond on the type bars to small letters situated in first case and to the same letters in capitals situated in second case. The character or characters at the top of some keys (digits or signs) are in 3rd case on the type bars.

As for groups, that is to say, the printing point of each letter, the keys which, for the first and second case positions bear only one consonant which is not followed by a Roman numeral (Z, P, C, N . . . ) belong to group I. When a key has a single letter belonging to a group other than group I, the group is indicated in Roman numerals ($U_{II}$,$I_{II}$,$E_{II,VII}$,$U_{,NIII}$,$R_{IV}$,$S_V$, for example)

The keys that bear a consonant followed by a vowel and which are situated in the rectangle K, PA, WA, WH correspond to a rectangular matrix similar to one included in the keyboard shown in FIG. 1 and already described. On each of these keys, the first letter belongs to group I and the second to group II. This is also the case for the keys FE and FA.

On the keys of column 14 and 15 each carrying two letters the group to which belongs the second letter is indicated by Roman number.. The electrical circuits are established in such a way that these keys automatically cause a simple spacing at the same time as the letters are printed. On the following keys of columns 13 to 15: HEIR, MAN, TION, FOR, THAT, WAS, YOU, THER, the first letter belongs to group I. On the key OUR, where the first letter is a vowel, this belongs to group II. On all these keys the letter following the first belongs to the groups that are numerically next. Thus, for example the key TION simultaneously controls letters of groups I, II, III, IV. These keys automatically cause a single space in addition to the printing of the letters.

The working of each of the six keys (FIGS. 7 and 8) to obtain different shift positions (case positions) has already been described. (Tout 2e (All 2nd), Bloc of Tout 2e (Bolt All 2nd), 2eI (2nd I), 2eII (2nd II), Tout 3e (All 3rd), Bloc of Tout 3e (Bolt All 3rd).

Certain keys with auxiliary functions are included in the keyboard.

→ = return of carriage

→ = backspace

← V = spacing of group V (producing a space of five intervals).

neut = neutralization of automatic spacing

Certain keys for well-known function could be placed on the edges of the keyboard. For example: Tabulation, Placing stops, Removal of stops. These have not been shown.

On this keyboard, several keys that each control a vowel of group III are located in two central columns (7th and 9th) though the corresponding type bars are situated more to the right. This removes the necessity of striking these keys through the displacement of the less adroit fingers of the right hand. Each of these keys (with the exception of $O_{III}$ of less frequent use) is besides duplicated and is found in each of the two columns 7 and 9. This increases the percentage of the groups of strikes by one hand only.

Figure 9:
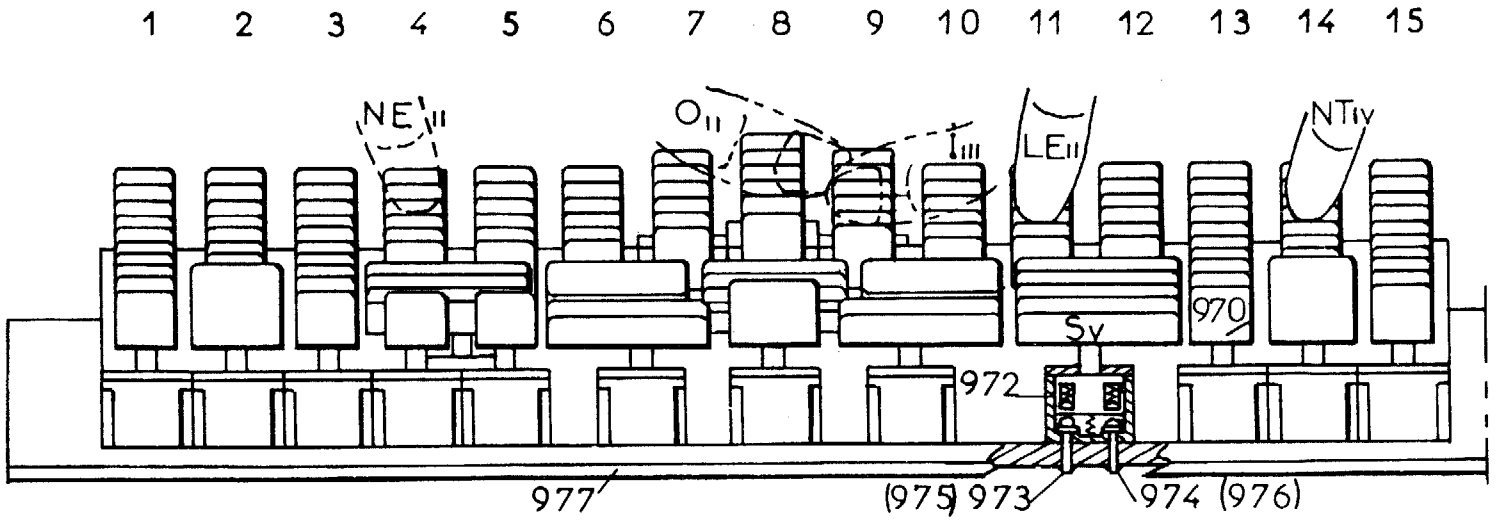
FIG. 9. Switchboard. Front view, showing the differences of level of the keys and the position of the fingers on certain keys.

In comparison with keyboards with mechanical connections, such as that shown in FIG. I, the number of thumb keys has also been increased. The horizontally extended keys as well as the two large keys "SP" are thumb keys. The keys "Tout 2e" (All 2nd) and "Tout 3e"(all 3nd) are palm keys and therefore are higher than the adjacent keys in the same row (FIG. 9). All the keys of the consonants of group III: $T_{III}$,$D_{III}$,$N_{III}$,$S_{III}$,-$R_{III}$ and the keys of the consonants of group IV: $T_{IV}$, $R_{IV}$,$S_{IV}$,$N_{IV}$, are each adjacent to one of the two spacing keys "SP" and at the same level as the latter. This allows each of them to be struck at the same time as this spacing key, by using one the two thumbs held horizontally. The other fingers could thus at the same time strike keys that correspond to letters of group I and II. Ths further increases the number of cases where the total of the number of simultaneous strikes is effected by one hand only.

The keys most often used of these keys: $N_{III}$,$S_{III}$,$R_{III}$ are situated between the two spacing keys and this allows each to be struck by either one of the two thumbs at the same time as a spacing key.

The use of electrical connections also allows an increase in the number of letters whose printing is controlled by the same key. Thus the keyboard shown in FIG. 8 comprises keys corresponding to the combinations: heir, tion, was, you, for, our ther, that, man; and these combinations each are automatically followed by a space. The key $S_V$ also causes a space automatically. One can thus make up electric circuits such as to control simultaneously by one key up to one character in each of the groups; thus up to five characters plus a simple space automatically when the machine is constructed with five groups. The most frequently occuring combinations of letters are taken for the language for which the keyboard is composed. The keys "Neut. SP." (Neutralization of automatic spacing) prevents automatic spacing from occuring when depressed and held depressed before a key equipped with the device of automatic spacing is struck.

AUTOMATIC SPACING

The spacing device is actuated by an electromagnet 3833. This permits to situate the keys that produce a spacing in the most suitable places. It is equally easy to enable any character key to act in the same manner. This is advantageous when the combination of letters controlled by the key considered is a whole word (qui, nous, vous) or else occurs generally in the last set of letters struck for a word (ment, tion). Thus, for example, in the keyboard (FIG. 8); all these keys of great combination in addition to printing the letters produce a spacing automatically.

The escapement mechanism places the spacing always to the right of the character belonging to the group of the highest rank among those printed simultaneously, even if these characters are printed by operating several keys, and this whatever be the character keys depressed. The result is that, for example, if one strikes simultaneously the key you, (groups I, II, III) which automatically produces spacing and the key "R" (group IV) which does not give a space, one gets "your" followed by a space, the spacing produced by the key "you" being placed after "R" of group IV. Statistics show, for each language, which character keys are profitably equipped with automatic spacing. The choice is made taking into account the fact that a key is available which allows the neutralisation of automatic spacing (this will be made clear later). For the automatic spacing to be useful the character or characters concerned should most frequently occur in the last group of simultaneous strikes for a word. Thus, for example, in the English keyboard (FIG. 8), this occurs for "THE" and "HE", for each of the combinations assigned to the keys of columns 14 and 15, as well as for "Was", "YOU", "THER" and $S_U$. To equip a key with automatic spacing, it is only necessary to add one wire and one diode.

NEUTRALISATION OF AUTOMATIC SPACING

The keyboard (FIG. 8) comprises the key "Neut. Sp.". (Neutralization) of automatic spacing) column 4 line 10. When this key is depressed and is held depressed during the striking of one character key equiped with automatic spacing, or successively on several of these keys this spacing is not effected. The electromechanic (scheme of FIG. 10) shows in effect, that the key "Neut. Sp." cuts off the circuit of the automatic spacing. It is useful to duplicate this key by a pedal having the same effect. The depression of this key or of this pedal cuts off the coil 3833 (FIG. 10) of the electro-magnet which controls the spacing device.

The existence of this neutralization key allows the use of each of the character keys equipped with automatic spacing where the corresponding characters are comprised in a group of a simultaneous printing which is not the last of the word.

The key or the pedal can also be used for neutralisation to avoid a double space when one of the keys equiped with automatic spacing is used before a word starting with a letter of group II.

THE SIMULTANEOUS STRIKING OF SEVERAL KEYS EACH PRODUCING THE SAME PRINT WHOLLY OR IN PART FOR A SPACING.

Given that the electric and the electronic circuits are set up (scheme of FIG. 10) there is no inconvenience involved in having one or more of the electro-magnets put into circuit simultaneously by several keys depressed at the same time. The effect is the same as if the electromagnet in question has been connected by a single key. One could either by error or in order to get a certain group of characters without spacing or with spacing simultaneously strike several keys even, if one or several parts of the actions engendered by the keys duplicate functions.

1st case

A character key equipped with an automatic spacing device and a simple spacing key are struck simultaneously. For example, The typist strikes the key "THAT" FIG. 8 equipped with automatic spacing and inadvertently also strikes a simple spacing key. Nonetheless only a single normal space is effected after the letters. The typing error was thus without effect.

2nd case

Two character keys each equipped with an automatic spacing device are struck simultaneously.

For example by striking simultaneously on the English keyboard (FIG. 8) the key "HE" (groups I and II) and the key "AR" (groups III and IV), both equipped with automatic spacing, it is possible to obtain in a single operation the word "HEAR". Only one space is effected and it occurs following the characters.

3rd Case

Two character keys, both equipped with an automatic spacing device and both actuating a character which is common to the two keys, are struck simultaneously. For example, to obtain by striking two keys the word "then", one simultaneously strikes the key THE (group I, II, III) and the key "EN" (groupe III and IV) both of which are equipped with automatic spacing. The duplicating of the "E" (group III) and that concerning the spacing remain without effect.

DIFFERENCES BETWEEN THE LEVELS ON WHICH ARE SITUATED CERTAIN KEYS OF THE SAME ROW IN THE SWITCH KEYBOARD.

On the keyboards of the type shown in FIG. 1 each key of the central column is positioned higher than the adjacent keys in the same row. On the keyboards of the type shown by FIGS. 7 and 8 there are three central columns of keys wherein keys of rows 1 to 6 are each more elevated than the other keys in the same row. Thus FIG. 9 which is a front view of these keyboards shows that in each of these rows the key of the central column key (8th) is higher than the keys of the two adjacent columns (7th and 9th) and the keys of these two columns are higher than the keys of the other columns (1st to 6th and 10th to 15th). Thus, in each of these rows (1st to 6th), the central key (column 8) can easily be struck by the inclined index finger of either hand or the thumb of either hand directed horizontally. We can see FIG. 9 shown in dot-dash lines the left thumb striking the central key $O_{II}$ of the 5th row. Equally for each of the rows 1 to 6, the inclined index finger, or the horizontally held thumb of the left hand can strike the key of the 7th column and the inclined index finger or the horizontally held thumb of the right hand, can strike the key of column 9. Thus FIG. 9 shows the right thumb striking the key $I_{III}$ of the 6th row. At the same time as these strikes another finger of the same hand or the other hand can strike another character key which is situated at the normal level or a space key. FIG. 9 shows the ring-finger striking the key "$NE_{II}$" while the right thumb strikes "$I_{III}$" to obtain "NEI" in the word "neither". The middle finger strikes "$LE_{II}$" while the right little finger strikes "$NT_{IV}$" to obtain, in a single operation, the ending "LENT" together with the spacing that follows it, the key "NT" being equiped with automatic spacing.

As it is shown in FIGS. 9 and 12, in each column the key surfaces of successive rows are arranged in steps, as normally used. Nevertheless the thumb keys and palm-keys do not fall within this rule as is explained below.

The space keys (FIGS. 7, 8 and 12) and the adjacent thumbkeys $2nd_I$, $2nd_{II}$, $M_{III}$, $T_{III}$, $N_{III}$, $S_{III}$, $R_{III}$, $T_{IV}$, $N_{IV}$, $S_{IV}$, $R_{IV}$, $S_V$ have their surfaces on the same plane in order that a horizontally held thumb can simultaneously strike a space key and one of these adjacent keys. The key $S_V$ is equipped with automatic spacing.

The plane of these elongated keys is lower than that of the keys CA to X, NA to SA, WA to THER; this allows the striking of each of these adjacent keys with a horizontally held thumb without knocking the elongated key. The palm-keys "all 2nd" and "all 3rd" are at a higher level than the adjacent keys in the same row in order that the palms do not knock these adjacent keys. The key "Return" (Carriage return) is also at a higher level, so that it can be struck along by either thumb horizontally held. The differences in the level indicated are a little higher than the vertical displacement for the corresponding keys.

KEY FAMILIES

In order to make the training of the typist easier and to reduce mental tension, the keys othe than those of the rectangular matrix already described are grouped by family. Thus one find in FIG. 8:

The vowels of group II in column 8 rows 2 to.6;

The vowels of group III in column 9 rows 2 to 6 and these are repeated (except $O_{III}$) in column 7;

The consonants of group III, thumb keys, at the centre and also to the left, but all adjacent to the spacing key at the left.

$N_{III}$, $S_{III}$, $R_{III}$, which are the most frequent are easily reached by both thumbs and each of these lie adjacent to both the spacing keys.

$N_{IV}$, $S_{IV}$, $R_{IV}$, $T_{IV}$ are arranged in the same order as $N_{III}$, $S_{III}$, $R_{III}$, $T_{III}$ but to the right and before the spacing key to the right.

Each of the keys of column 14 except TION, FOR, THAT carry a combination of two characters of group III and IV respectively and is equipped with automatic spacing.

Several keys carrying a combination that makes a complete word are located in the fore part of columns 15, 14 and 13.

Those among the consonants of group I that are not twinned with a vowel of group II in the rectangular matrix that nontheless have a medium frequence are in row 1 (K, H, G, B, F) and this facilitates striking them while simultaneously striking a vowel of group II located in column 8 (central); those with weak frequence (Q, Z, V, J, X) are grouped in the front left-hand corner of the keyboard.

The relative positioning of these different families of keys and the order of characters or combination of characters within each family as well as the placing of each key in relation to the others, have been decided upon in order to simplify fingering especially when several keys have to be struck at the same time (we/ar, wo/nt, ti/e, wh/en, so/on, te/a. . .) or one after the other as in (ra/tion... re/la/tion..., is on..., for you. . .)..

All the rules which have been taken into account, some antagonistic to others thus necessitating compromises, cannot be detailed here, but these rules have been studied as a whole takaing into account their respective importances to establish the choice of keys to be made and their positioning. Only the actual use of this keyboard shows clearly its advantages in comparison with the earlier ones.

The use of the same means, keeping the same physical structure but using statistics of letters frequencies and of their combinations frequencies in every language using an alphabet allows the creation of a keyboard for each of these languages.

DIFFERENCES BETWEEN THE SWITCH KEYBOARD LAID OUT FOR THE ENGLISH LANGUAGE AND THAT LAID OUT FOR THE FRENCH LANGUAGE.

FIG. 8 shows a keyboard similar to that shown FIG. 7 but laidout for the English language. The main differences of this keyboard with reference to that laid out for French are the following:

FI (column 1) is cancelled and replaced by FE;

J (column 1) is switched around for K (column 2);

Y (column 2) is displaced and replaced by HE;

In row 1, column 1 to 12: the keys DU Té é Ré LU SU are replaced respectively by CH TH THE $Y_I$ $Y_{II}$ SH In column 13, rows 1 to 6: V and its combinations have been replaced by W and its combinations and the letter V is substituted for W in column 1;

$M_{III}$ (thumb key) is cancelled and replaced by $D_{III}$;

The apostrophe (Col 7) is put in case position 3 above V (col 1)

In columns 13, 14 and 15 the combinations, corresponding to endings or whole words and equipped with automatic spacing are different. Since the corresponding keys each control the characters by a single wire with shunts, this last change does not modify the network of the printed circuit shown in FIG. 11. In this network the line $é_{II}$ becomes $H_{II}$.

OTHER USES OF ELECTROMAGNETIC MEANS

The advantages obtained by using a keyboard of switches which control the engagements on the driving cylinder by means of electro-magnets are so important that they may be used even for syllabic typewriters which are not controlled remotely or automatically.

FIG. 12 shows the whole of a machine thus equipped with a switch keyboard and with electric and electronic circuits allowing the keys of this keyboard to control electromagnets for the engagements on the driving cylinder. In this form of embodiment the escapement mechanism is also equipped with electromagnets

THE MACHINE AS A WHOLE WHEN ELECTROMAGNETIC CONTROLS ARE USED

An embodiment of the whole machine (FIG. 12) will now be described which combines certain of these mechanical arrangements with electromagnetic variants.

The following parts are replaced by electric connections:

all the transverse countermotion devices such as 748, 752, 740 (FIG. 5).

the longitudinal levers such as 741, 746, 780 (FIGS. 5 and 2) and the parallelograms 761–763;

the sliding device that prevents repetition 776 (FIG. 6);

the escapement group bars 271 (FIG. 5);

all the parts which transmit the movements of these escapement bars.

A keyboard of the type shown in FIG. 7 is used. The keys each constitute a push button of a contact-switch 972 of well-known type (FIGS. 12 and 11) which when a key is struck close two circuits and cuts these off again when the key is released and rises back. Each contact switch presents four pins 973 to 976 placed in the form of a square.

Figure 11:
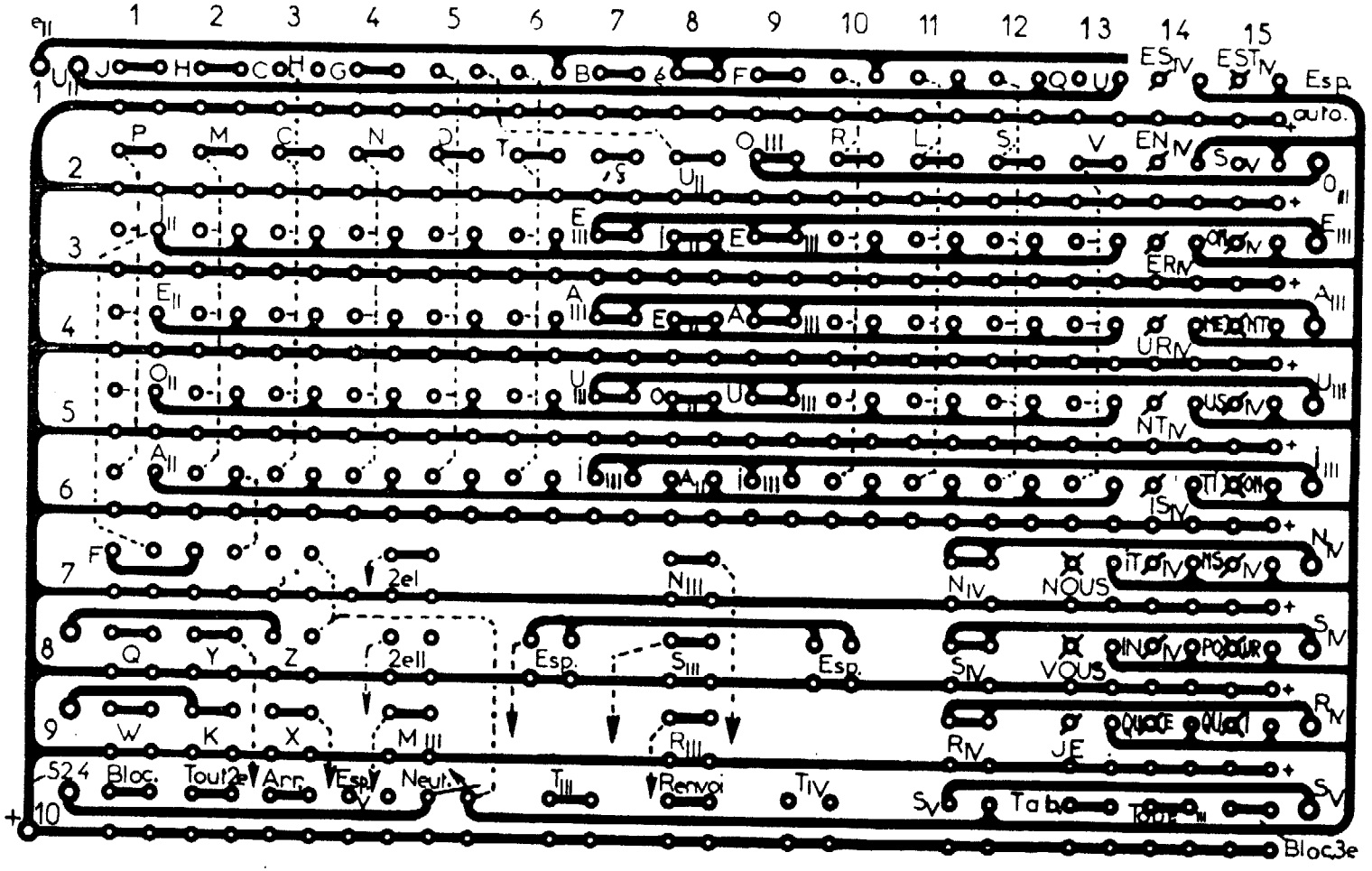
FIG. 11. The whole of the circuits that correspond to the keyboard made up of switches that each close two circuits. Part situated under the switches and which constitutes a printed network. Top view.
Figure 13:
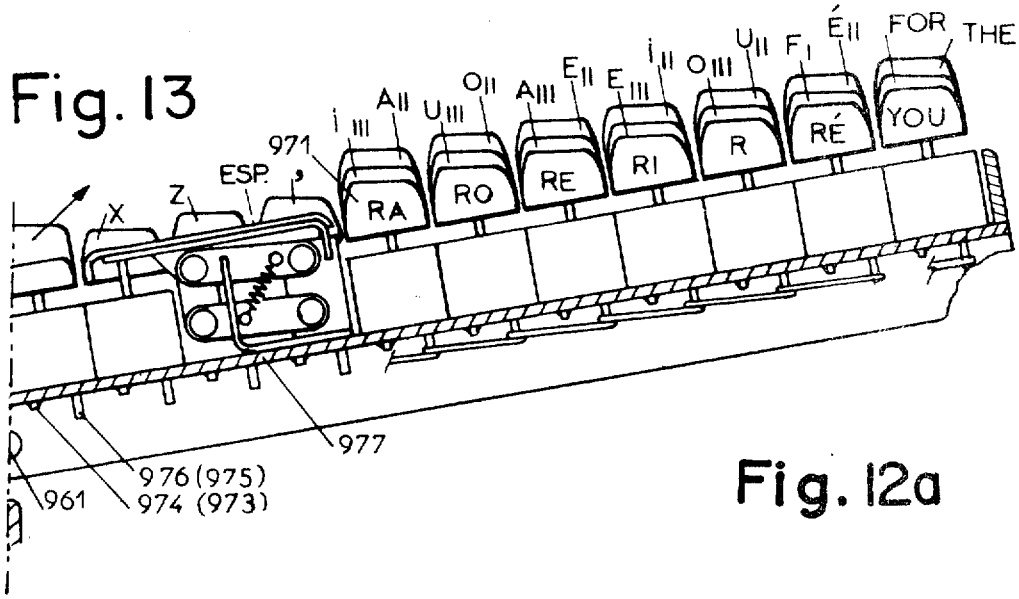
FIG. 13. Variant relating to the shape of the keys, the arrangement of the keyboard switches and the shape of their support.

The keyboard comprises a plate 977 whose lower face constitutes the support of a printed electric network shown by the scheme of FIG. 11. This plate is perforated with holes at regular intervals which correspond to the distance between the pins of the contact switches. The contact switches are placed on the upper surface of the plate 977 with the equipment shown in FIGS. 7, 9 and 12. The four pins of each contact-switch pass through the plate by four neighbouring holes. The holes of the plate that are shown in scheme of FIG. 11 are the ones actually used to allow passage of the pins. If keys with a normal surface 970 (FIG. 12) are used the contact-switches are placed vertically on the steps in order to get a difference in levels between successive rows. For this, skewed shims 978 are placed on the plate 977 which is inclined. These shims could be cast with the plate. As shown in FIG. 13, keys 971 of well-known type, with oblique surface, may be used. This provides differences of level between the successive rows of keys by just placing the contact switches directly on the inclined plate 977 which in this case does not have a stepped surface.

A direct or rectified alternating current is used, for example at 48 volts or 24 volts. The two pins 973 and 974 (FIG. 9) in the fore part of each contact-switch constitute the entry point of each circuit. The length of these pins is limited to that which is necessary to solder them to the supply line of the printed network. The two pins, 975 and 976 (FIG. 13) at the rear of each contact-switch are longer to enable several to be connected to the same wire 698 (FIG. 12) or for some of them to link on to a wire equipped with a movable socket 979.

The details of the printed circuit is shown in the scheme of FIG. 11. This will be explained below.

The plate 977 (FIG. 12 or 13) is articulated on a shaft 961 and all the electric wires which link the keyboard to the machine pass close to this shaft. If the front guard 982 of the bonnet is lifted it is possible to lift and turn over the keyboard to have access to the switch circuits and to the arrangements located below the keyboard.

The device 983 which regulates the printing force, is identical to that used in certain electric alphabetic typewriters. The electro-magnets such as 901 and 902, their mobile armature 904 and the rods 906 by which they engage the cams 773 on the driving cylinder 771 are identical to those used in usual electric type-writers to achieve automatic control.

In the printed network shown in FIG. 11, the single ramified line 524 starts from the source of electricity. From this line shunt lines issue which supply each of the two input pins of all the contact-switches of the keyboard which correspond to each row of keys. The connections that link the two output pins of each contact-switch to the electro-magnet that the corresponding keys have to put into circuit will be described later. Some of these output connections are made up in part by a line from the printed circuit (FIG. 11) and others are entirely wired (FIG. 12). All of them end finally at a connecting rod 986. This connecting rod allows easy dismounting and changing of allocation for certain keys or for certain type bars. The machine optionally comprises a commutator 987 of well-known type. Some of these electric connections between the contact switches of the keyboard and the connecting bar go through this commutator. The commutator allows the typist to change the characters assigned to certain keys. One can thus obtain a bilingual machine. This possibility will be fully explained later. The commutator allows instantaneous adaptation of the machine to a particular class of work in which certain terms occur frequently.

At the exit of the connecting bar 986, the wires are grouped in different strands, which travel alongside the fore part of the machine, some to the left and others to the right and then reenter the machine and distribute the wire-ends in the connecting bars 988 and 989. The input wires of the upper electro-magnets such as 901 are connected to the output of the upper connecting bar 988 and the input wires of the lower electro-magnets such as 902 are connected to the output of the lower connecting bar 989.

The output wires of these electro-magnets are connected in a detachable manner to a common output conductor 990 or 991 located as well in each of the connecting bars 988 and 989. The electric circuits by which the keys engage the cams on the driving cylinder are thus defined in physical form. It will be seen that for certain character groups a shunt 960 is connected to certain of these circuits in order to control the escapement directly by the corresponding character keys. The movement of the intermediate levers 147 or those of the character bars 267 will not be reiterated here. The lower end 692 of each intermediate lever causes a same common paddle 992 to pivot around its shaft 277. This paddle controls the rise and transport movements of the ribbon. All the parts of these devices are identical with those of usual alphabetic type-writers.

The paddle 992, while pivoting meets in the end of its movement the lever of a micro-switch 994 and pushes it. This cuts off the supply circuit for the keys so that the electromagnets for engagement such as 901 and 902 and those such as 941 for the escapement do not remain too long in circuit, and in order to avoid accidental repeats before the keys rise back. This technique is well-known.

The shift mechanism enables the typist to place the sectors in three different case positions.

The carriage is identical or similar to that of an ordinary alphabetic typewriter. Its cylinder is not vertically mobile unless the machine has four characters on each type bar.

The escapement mechanism comprises a wheel with movable cogs, combined with an escapement anchor or with an electromagnetic relay that produces the spacing. The displacements of the cogs of the wheel and of the anchor are obtained by electromagnetic means already described and which will be detailed later.

ELECTRIC CONNECTIONS BETWEEN, ON THE ONE HAND THE KEYS AND ON THE OTHER HAND THE ELECTROMAGNETS WHICH CONTROL THE PRINTINGS.

The electric network that enables the keys to control the printings and the escapements is made up of elements already well-known. The network could be entirely cabled, but, in the example, it is partly printed. In order to obtain that the descent of a given key produces the simultaneous printing of several characters (as many as five characters, and possibly the space which must follow them) it is necessary that this descent put into circuit several electromagnets. To obtain this one can either cause the key to close simultaneously several contacts, or divide the impulse created by a single contact towards different electromagnets, this by means of shunts each equipped with a diode. In the described example these two means are combined.

Figure 10:
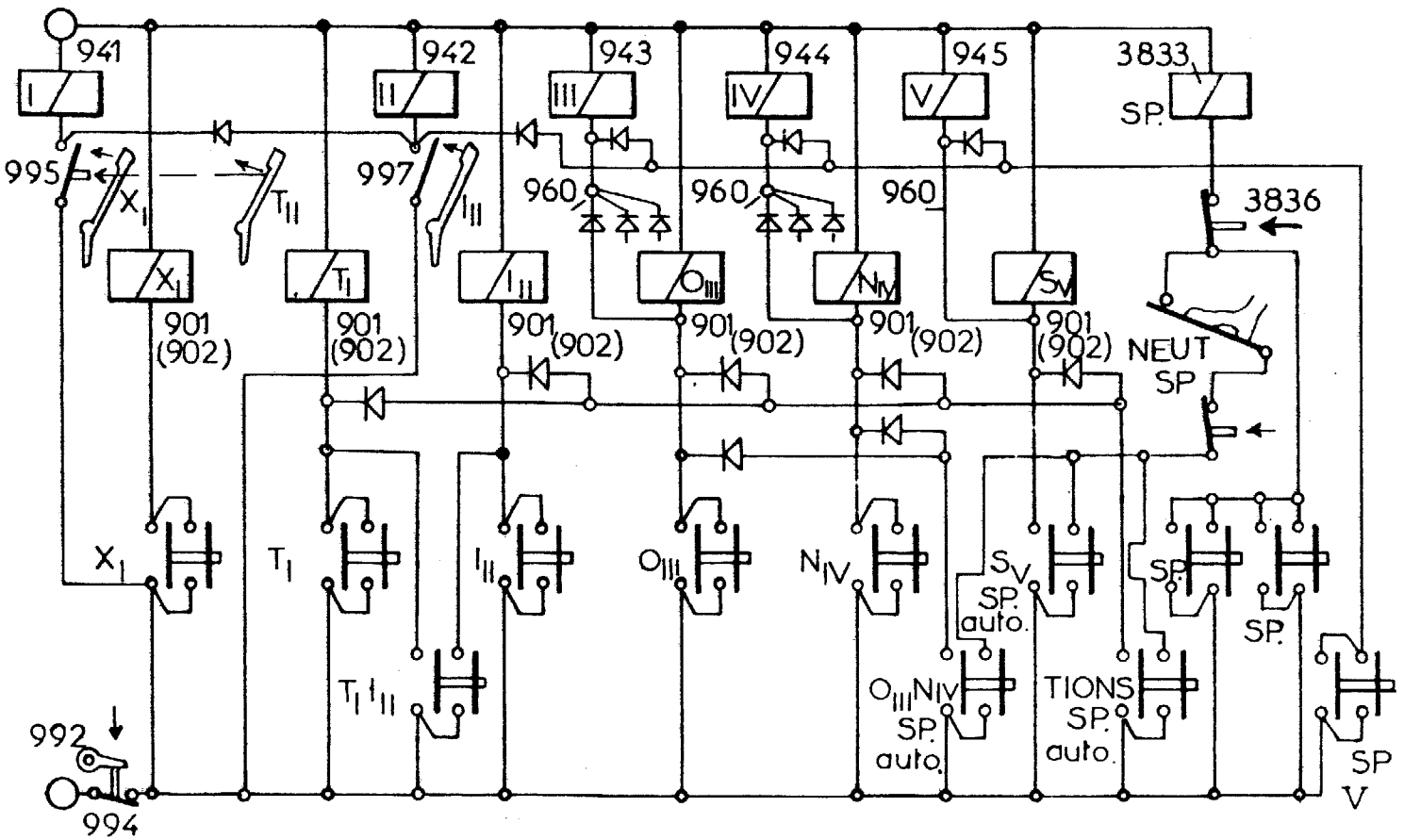
FIG. 10. Scheme of the assembly of the electrical and electronic circuits by which the switches of the keybboard actuate the printings and escapements.

In the electromechanic scheme of FIG. 10, the letters and combinations of letters, given as examples to indicate the different circuits, assume that the keyboard shown in FIG. 7 layed out for French is used. This schema shows the circuits only for a few keys each controlling one or several characters, some with automatic spacing, the others without automatic spacing. This scheme also shows the two space keys. Each key is marked by the inscriptions which it bears on the keyboard. In the scheme each of the electromagnets which engage on the driving cylinder, the cam which controls the printing of a given letter is marked with this letter ($X_I$ to $S_V$) followed by the group number (I to V). The electromagnet which controls the escapement anchor is marked "Esp." (spacing)

The electromagnets only marked with a group number (I to V) are those which each control on the escapement wheel, the retirement of the cog which, at the considered moment, corresponds to the indicated group (cog situated in one of the places 1 to 5).

When a key controls only the printing of a single character without spacing (e.g. $X_I$, $T_I$, $I_{II}$, $O_{III}$, $N_{IV}$) the two output contacts are linked. When a key controls the printing of two characters without spacing (e.g. $T_I$, $I_{II}$) each of the two contacts controls one of the two characters and no diode is necessary. When a key controls a single character with the automatic spacing ($S_V$ space), one of the two contacts is used for the printing of the character and the other for the automatic spacing. When a key controls several characters and the automatic spacing (e.g. ON space, TIONS space) one of the two contacts is reserved for the automatic spacing and the other is used to control the printing of all the characters, by means of shunts each equipped with a diode.

The keyboard shown by FIG. 8 comprises a key "TION space" but comprises no key "TIONS space". In the scheme of FIG. 10 it is nevertheless supposed that such a key exists, this in order to show that one can, optionally, control up to five characters plus one spacing simultaneously by a single key.

It is obvious that the network as a whole may be transistorised. The necessary modifications for this are known.

The diverse electric circuits will be detailed later with indications concerning their localisations.

The parts of the electric circuits that are printed are shown in straight lines in FIG. 11 which is drawn as if the switches have been removed and that the support plate 977 is transparent. The nbetwork is so shown from above, which facilitates its comparison with the keyboard shown in FIG. 7. It is on this FIG. 7 that one will read the attribution of the key which corresponds to the contact switch whose four pins are placed in each grouping of four of the holes shown by the scheme 11. This schema shows only each of the holes effectively used, i.e. in which one of the pins of a contact switch of the keyboard is placed. The dotted lines represent parts of the circuit that are not printed, i.e.; wires such as 698 FIG. 12 that are situated lower than the support-plate 977 and are each connected to a pin of certain contact switches.

When the free surface FIG. 11 enables it, a printed line passes by all the output pins of the contact switches that control only the same character.

A few contact switches each control an electromagnet other than those which cause, each one, the printing of a character. Some control the electromagnet corresponding to the escapement anchor. Others control an electromagnet of the shift mechanism. Finally, certain control an electromagnet that corresponds to an auxiliary function (return of the carriage, back space, etc.).

The electric lines which feed the contact switches of keyboard shown in FIG. 7 which enable them to transmit the impulses to the different electromagnets, may be classified in the following categories:

1ST CATEGORY.

Network of the entrance electric lines which feed two pins of each contact-switch. It is the network FIG. 11 for the transverse lines which start from the line 524; these are connected to the electric source. This feeding network comprises one electric line for each row of keys of the keyboard. These lines constitute a regular network of parallel lines, from row 1 to row 10.

2ND CATEGORY.

Output lines each corresponding to one of the letters of group II. They are parallel to the preceding ones. These are the lines $A_{II}$, $O_{II}$, $E_{II}$, $I_{II}$, $U_{II}$, $e_{II}$. Each links an exit pin of each keyboard-switch comprised in the rectangular matrix I-II and which bears the corresponding letter to the electromagnet for engagement on the driving cylinder such as 901 or 902 (FIG. 12) which corresponds to this letter.

3RD CATEGORY.

Output lines each corresponding to a vowel of group III. They are parallel to those of the first two categories. They are the lines $I_{III}$, $U_{III}$, $A_{III}$, $E_{III}$, $O_{III}$. Each constitutes the output line, either of the corresponding contact-switch ($O_{III}$), or of the two corresponding contact switches situated one in column 7 and the other in column 9. The two output pins of each contact switch are linked.

4TH CATEGORY.

Output lines of one of the two pins of each of the contact switches which are equipped with automatic spacing. These lines also are parallel to those of the preceding categories. All are linked to the line "Esp auto", which controls thhe escapement anchor and which is found again in the schema FIG. 10.

The line "Esp.auto" (schemes FIG. 11 and 10) is distinct from the output line of the two space keys "Esp." because the line "Esp.auto" must be able to be cut off by the key for neutralization of the automatic spacing "Neut.esp." as well as by the pedal which, optionally, duplicates this key and does so without cutting the exit line of the space keys "Esp".

The electric lines of categories 1 to 4, all being parallel, are parts of the printed network (FIG. 11) on the lower face of the support plate 977 (FIG. 12 or 13).

5TH CATEGORY.

Output line corresponding to the two space keys "Esp." (FIG. 11 and 10). It has been said that this line is distinct from the line "Esp.auto". It is nevertheless rejoined by this one after the above mentioned cut-off.

6TH CATEGORY.

Lines, each corresponding to one or two pins of a contact switch whose key has one of the following assignments:

one letter of group I, not frequent and not combined with keys of group II in the matrix. These are: J, H, G, B, F, punctuation, Q, Y, Z, W, K, X (FIG. 7);

one of the consonants of group III (N, S, R, T, M):

one of the consonants of group IV (N, S, R, T);

one of the auxiliary operations (back space, carriage return, shift keys etc...).

For some of the lines of this 6th category, corresponding to a contact switch which is not on the edge of the keyboard, a part of the line parallel to that of the preceding categories is printed when the space required is available; for example, $Z_I$ and $K_I$. Each one of the other lines of this category is made up completely of a wire connected to one of the output pins of the contact switch. The two pins are linked, except for the contact switch $Z_I$ of which one pin is connected to the line which gives the automatic spacing "Esp.auto".

7th category.- Frequent consonants of group I which, in the matrix, are each combined with one of the letters of group II situated on different rows of keys. These are P, M, C, N, D, T, R, L, S, V. As the electric lines which correspond have to be perpendicular to the preceding ones, each one comprises a wire which is connected directly to one of the two output pins of each of the corresponding contact switches. In the scheme of FIG. 11, these lines, perpendicular to the preceding ones, are shown in dotted lines. In FIG. 12, by the example of wire 698 of the column "R", it is shown that the corresponding pins are longer than the others, and that, due to this, these wires form a second network situated below the printed circuit network. This network could instead be made up of printed lines on the upper face of the support 977 (FIG. 12) on a distinct layer on the lower face of this support FIGS. 12 and 13), or on a distinct support, but modification and replacement of a contact switch would then be more difficult.

Each of the lines of the categories 1 to 7 is extended by a wire connected, by means of a socket such as 979 (FIG. 12) to one of the pins of the corresponding contact switches. It is preferable to select a pin situated close to the edge of the keyboard.

When a contact switch is the only one which controls a character or a given electro-magnet and if no line corresponding to it has been printed, the wire is connected, in the same manner directly to one of the two output pins of this contact switch and the two output pins are linked.

8TH CATEGORY

Electric lines going from a contact switch which controls one of the combinations of characters situated in the columns of keys, 14 and 15 (FIG. 7); or one of the three combinations of the column 13: Nous, Vous, Je (FIG. 11) shows that one of the two output pins of each of the corresponding contact switches, is situated on one of the printed lines which rejoin the line controlling the automatic spacing (Esp. auto).

On the other output pin is connected a socket attached to a wire controlling all the letters of the combination corresponding to the key. This wire splits in shunts each one equipped with a diode and corresponding to one letter in this combination. Each electric line corresponding to one or several letters finally leads to the corresponding electromagnet for engagement such as 901 or 902. The wiring shown by scheme of FIG. 10 indicates these connections by an example for each case.

The different wires corresponding to the same category join into a strand that goes along the edge of the keyboard on the right or on the left and then distributes the opposite ends on the connecting bar 986 (FIG. 12) or in the commutator 987 if the machine includes this component. In this latter case, the commutator outputs are connected, through other wires, to the entries corresponding to them in the connecting bar 986. The continuation of these circuits has been formerly defined. For the combinations of the letters situated in the columns of keys 14 and 15 (FIG. 7), as for the combinations NOUS, VOUS, JE in the column 13, on each of the left hand pins of each contact switch (FIG. 11) the number of characters has been conventionally indicated by as many diverging short strokes (e.g.: two strokes for the pins corresponding to ES, EN, ER . . . column 14, four strokes for NOUS, VOUS, column 13).

In each group I to IV, the characters of the group are distributed among the type bars so as to have the characters frequently used born by type bars near the center, which, therefore, work better mechanically and, conversely, to place the characters not much used on the type bars far from the center. Characters which are frequently used one after the other are not placed on type bars next to one another, this to reduce the risk of collision. These means are well known but cannot be used to a maximum in syllabic machines when the connections are mechanical. In the present embodiment it is sufficient to establish consequently the electrical connections between the connecting bars 986 and 990 or 991.

The use of connecting bars facilitates the changing in the attribution of certain keys to adapt the machine to a particular class of work or to a different language.

DIFFERENT TYPES OF KEYBOARDS CONSTITUTED BY CONTACT SWITCHES.

Finally, in the second embodiment of the machine, the keyboard with contact switches can be selected from the following types, depending on the use to which it is to be put.

1st type.- Keyboard specially composed for a given language (although other languages can be printed with it), for example that shown in FIG. 7 for French or in FIG. 8 for English.

2nd type.- Bilingual keyboard, presented with the same composition as one of the keyboards of the 1st type, for example that shown by FIG. 7 for French, but fitted with a commutator 987 (FIG. 12), which enables the operator to change the character assignment to several keys, in one operation, so that this keyboard becomes identical with another of the first type, composed specially for a second language, for example identical with that of FIG. 8 composed for English. Most of these several keys with permutation being situated on the edge of the keyboard (1st row of keys and 15th column), the second assignment to each key is inscribed next to the key considered. For the others it is inscribed on the front face of the keys. The bilingual keyboard of this type is convenient especially when several operators will be using the same machine, each person for his own language.

3rd type. Bilingual keyboaard like the preceding one. It includes the same keys as one of those of the 1st type composed specially for a given language, for example that shown by FIG. 7 for French. It also includes a row of additional keys situated at the rear of the keyboard. These keys are assigned to the most frequent associations in the second language, for example, English, In this example the fifteen additional keys (FIG. 14) are assigned to the following associations: HEIR., MAN., HE., GH., THAT., TH, $THER_1$, THE., FOR., YOU., OUR., SH, WH, WAS., VE. It has been said that in the present text the underlying dash which follows an association of letters indicated that a space is included automatically. All the keys of the above combination therefore include a space, except GH, TH, SH and WH. In the drawings of the keyboards, this underlying dash is replaced by a small arrow.

Figure 14:
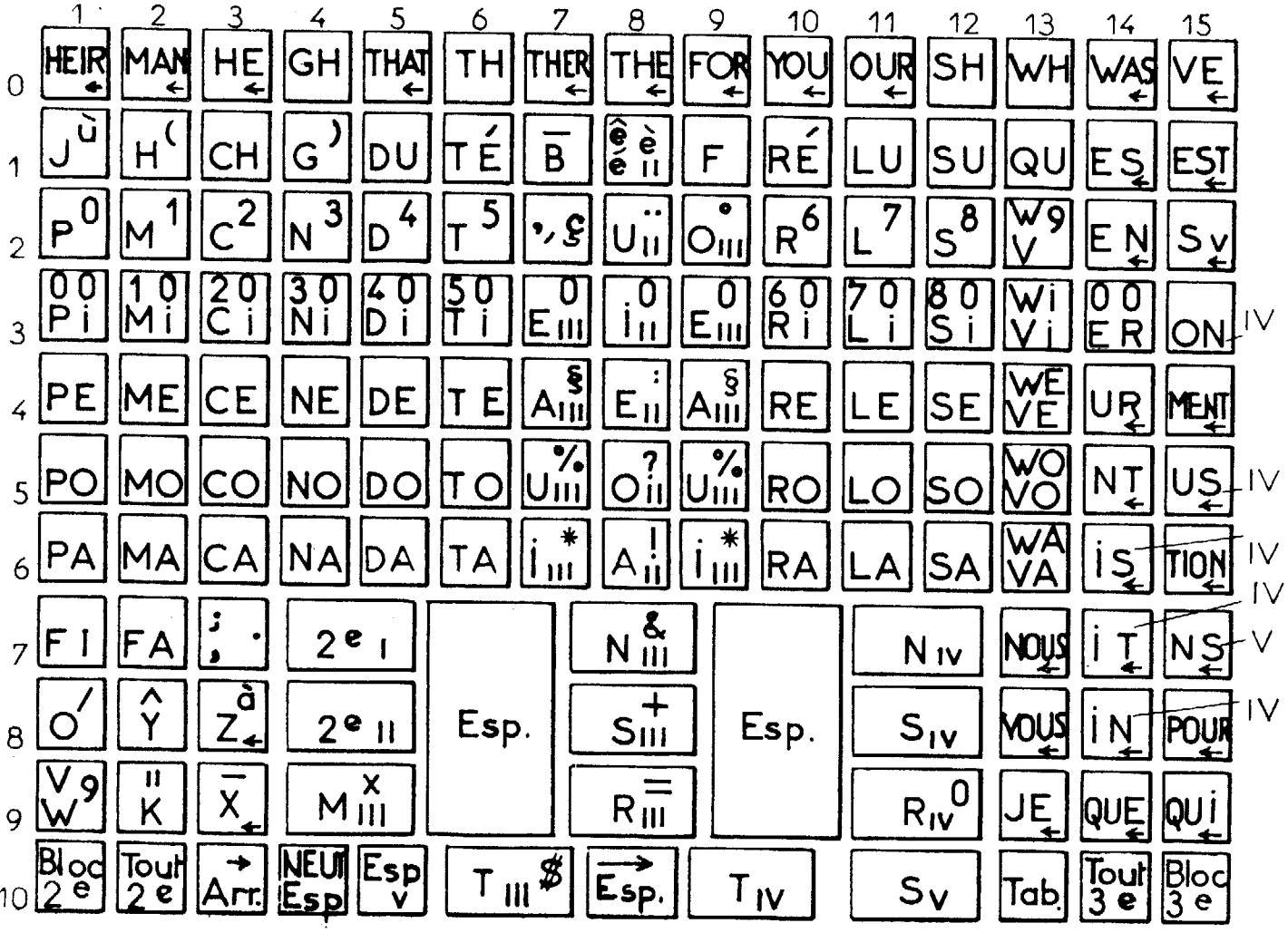
FIG. 14. Bilingual keyboard including a row of supplementary keys and certain keys whose attribution may be modified by a commutator.

In addition, this keyboard is equipped with a commutator 987 (FIG. 12), as is the preceding one. This commutator only exchanges the character assignment to a few keys. These, in FIG. 14, are: W, V, and the combinations VI, VE, VO and VA in column 13. They become: V, W and the combinations; WI, WE, WO and WA respectively.

For the second language, this keyboard is very slightly slower than the keyboard composed specially for the language considered. However it is particularly suitable when the same operator (for example French) will be typed alternately in the two languages (for example, French and English). The fingering of the operator is not altered when the language is changed except for a few keys (V,W and their combinations in the example given). This is hardly a problem as the W is rarely used in French and the V in English is only used frequently when followed by E.

VARIOUS COMBINATIONS OF A KEYBOARD OR OF A COMPLETE MACHINE, AS DESCRIBED, WITH OTHER ELEMENTS.

The machine, whatever of the keyboard which is used from amongst those described, can easily be connected up in such a way that the keyboard controls other similar machines or different syllabic printing mechanisms at the same time, or so that its printing mechanism be controlled by the keyboard of another machine with an identical keyboard, or by a storage unit.

It can also be connected in such a way that its keyboard controls a storage device at the same time, for example, a recording device in a magnetic storage unit, or card or tape punchers, this storage medium being designated to control a printing mechanism afterwards. This latter can be either the printing mechanism of the machine itself or another one.

For these last uses, a complete machine, such as the one described, can be used, or the keyboard on its own with the electrical circuits which it uses, without using the printing mechanism.

The syllabic keyboard can even control a printing mechanism which is alphabetic (non syllabic) through the intermediary of a buffer storage unit.

In reality, there is always a printing mechanism but this, in certain cases, is at a distance and the printing is sometimes deferred, thanks to a storage unit.

Considering the assembly of the envisaged combinations, of either the entire described machine or one of the sub assemblies, with one or several other mechanisms or devices, or with another machine, two classes can be distinguished:

1st class

The described syllabic machine or one of its sub assemblies, controls, optionally or permanently, a printing mechansim which is at a distance and this, either directly or through a storage unit. In this case the machine is called a "transmitter".

2nd class

The printing mechanism of the machine, which is syllabic, is controlled by a device which is at a distance, directly or through the intermediary of a storage unit. In this case the machine is called a "receiver".

In the case where the machine (FIG. 12) is a transmitter, an additional circuit is established at each exit from the bar 986, connected at the other end, either to the circuit corresponding to the exterior printing mechanism which the machine is to control directly or to the suitable elements which correspond in the recording device for the storage unit which is to be inserted eventually. Where the machine is a receiver, the additional circuit, from the remote mechanism which controls the machine directly, or from the storage unit which controls it after the striking, is connected at each entry of the bar 986; through these circuits, the impulses, depending on the circuit, pass to control a character, a space, or an auxiliary operation. Several of these impulses are simultaneous, however, as if they came directly from the keyboard of the machine.

If a buffer storage is used, the recording device, the memory medium and the device which controls the displacement of the latter, as well as the reader are each, according to the case, included in the machine or next to it, or at a distance.

The keyboard can be used in an assembly which does not include any printing mechanism situated near it, but only a storage unit.

Therefore, in FIG. 12 only the keyboard and the circuits which it controls up to and including the bar 986, are retained.

When using a memory medium made up of a magnetic or punched tape and if the printing mechanism which the memory is to control later is syllabic, recordings which are simultaneous but in which each element or group of elements corresponds to a character or a space, according to a code, can be used.

In this case, to record a syllable or part of a syllable in the memory, the different elements or groups of elements corresponding to different characters and to the possible space which corresponds to the key or keys which are depressed simultaneously, are recorded simultaneously. If a code which is habitually used to control an alphabetic (non syllabic) printing mechanism, is employed, each of the elements coded and recorded in a different transversal line in the memory, that is, in a line perpendicular to the direction of advance.

These different elements of the code can thus be recorded simultaneously by an assembly of devices (punchers or magnetic recording heads) which cover several of these lines on the memory medium (such as, for example, punched or magnetic tapes or cards).

The advance of the tape (punched or magnetic) is controlled by a device which makes it advance in a jump after each assembly of simultaneous recordings, the successive jumps being of different lengths, proportional to the number of characters and possibly increased by one line for a space.

Alternatively, the recording may be realised simultaneously in a primary memory (buffer storage) made up, for example, of a shift register. This primary memory then transmits, successively, each of the elements or groups of elements, each one corresponding to a character or a space to a second memory which can be for example: punched or magnetic card of tape or magnetic disc. This solution enables the use, for recording in the second memory, of standard devices used normally when the printing is alphabetic (non syllabic) that is, character by character the space being controlled on its own.

If the printing mechanism to be controlled later by this second memory is itself syllabic, in order to control the printing afterwards use is made of a reader-decoder, which is made up in such a way as to effect simultaneous reading of the different lines of the memory in which the recording has been effected for the same group of simultaneous impressions.

A jump is controlled by a signal which has been automatically recorded during the recording of the group of elements in the memory. These jumps may instead be controlled by the wheel with moveable cogs already described. This solution enables the same recordings to control either a syllabic printing mechanism or an alphabetic (non syllabic) printing mechanism, at a later date.

In order to avoid jumps of different lengths, recording without a code and reading without decoding may be used. In this case the first buffer storage device the mechanism which alters the lengths of the jumps and the use of a decoder are suppressed.

The memory medium, in this case, must be wide enough to include as many tracks as there are character supports (such as type bars) and auxiliary controls. In this case, for example, approximately 46 tracks are required for the characters, plus the tracks for the controlling of auxiliary operations giving a total of 50 tracks to control a syllabic printing mechanism similar to the one which has already been described.

Such a recording without a code can be used in the case where the printing mechanism which is to be controlled is alphabetic (non syllabic) but also when this mechanism is syllabic. When it is syllabic, a special code which enables the expressing of all the combinations of characters, with or without spacing, which can be struck in one operation of the syllabic keyboard shown in FIGS. 7 or 8, or on a similar keyboard, and of all the auxiliary operations, can be adopted. To obtain this, the device must be able to record simultaneously 15 marks (holes or magnetic recordings) in the memory. This reduces the tape width to one permitting 15 or 16 tracks or channels.

Another solution, which also enables the avoiding of jumps of differentiated lengths, consists of realising each of the groups of recording simultaneously on two successive lines of the tape. The width of the tape only requires the use of 8 tracks. The jumps are uniformly of two lines, thus enabling the use of a simple device, similar to those normally used when the advance is uniformly of only one line, to control the jumps. But, in this case, the reader must be made up in such a way as to enable each of its reading elements to cover and to read two lines at a time.

The successive recordings of the elements are controlled directly by the striking, without the interposing of a buffer storage.

In the cases where the keyboard is syllabic but where the printing mechanism is alphabetic (non-syllabic), one benefits, for the typing of a text and for its recording in the storage, from the full increase in speed which the syllabic typing on the described keyboard gives, in comparison with the typing on the alphabetic (non-syllabic) keyboard.

At the moment when the storage device controls the non-syllabic printing device the printing is obtained at the maximum speed at which the printing device considered can function.

In the case where the printing mechanism which the storage device will control afterwards is itself syllabic, one benefits, for this printing, from the increase in speed resulting from the syllabic printing, in relation to non syllabic printing.

Thus, for example, if the printing mechanism includes type bars, the syllabic printing enables a speed more than double that of a non-syllabic device with type bars.

A definition has just been given of the outlines of various means, each one of which enable the realization of several combinations between a syllabic keyboard and a printing mechanism, which is either syllabic or alphabetic (non-syllabic).

For a given combination, one considers not only the components united one next to the other in a given machine but also the elements at a distance one from the other and which function as a unit, either at the same time or at different times, one then controlling the others by means of a storage unit.

For example, if one keyboard controls the recording in the storage, the latter controlling a printing mechanism afterwards the keyboard, the storage unit and the printing mechansim are all part of the same combinataion.

A list of such combinations with a brief description of each follows.

Each definition is preceded by a symbol made up of capital letters for the substantives and small letters for the adjectives as well as for the form of storage medium.

| In these symbols: | | |
|---|---|---|
| C = Keyboard | b = band or tape | s = syllabic |
| I = Printing mechanism | c = card | a = alphabetic |
| | d = disc | (non syllabic) |
| M = Memory | e = electronic | m = magnetic |
| | n = numerous | p = punched |

The list which follows is not limitative.

CS IS - SYLLABIC KEYBOARD CONTROLLING A SYLLABIC PRINTING MECHANISM

This, for example, is the combination already partially described and of which an embodiment is shown in FIG. 12. The keyboard controls the printing mechanism through mechanical, electrical or electronic connections. Printing is immediate.

Cs n Is.- Same combination as Cs Is but the keyboard controls, at the saame time and in addition, one or more other syllabic printing mechanisms situated outside the machine of which it is part. These mechanisms can be identical to the one forming part of the machine, or they can be similar or different.

Cs Is M.- Same combination as Cs Is but the keyboard also controls in parallel, a storage unit. This unit can be part of the same machine or situated at a distance and linked to the circuits through which the keyboard transmits pulses. It is intended to control printing by one or more printing mechanisms afterwards.

Cs Is Mp.- Same combination as Cs Is M but the recordings in the storage unit are constituted by punching.

Cs Is Mm.- Same combination as Cs Is M but the storage unit is magnetic.

Cs Is Mdm.- Same combination as Cs Is Mm but the storage unit is constituted by magnetic discs. This form is particularly interesting for the recording of standard paragraphs of letters or of information which must be founded again rapidly.

Cs M.- Combination of a syllabic keyboard with a storage unit. The memory unit serves to control a printing mechanism afterwards. This combination is the same as Cs Is M with the difference that the machine has no printing mechanism incorporated in the same assembly.

Cs M Ia.- Combination of a syllabic keyboard with an alphabetic, non-syllabic, printing mechanism by the intermediary of a buffer storage unit.

The buffer storage unit receives pulses corresponding to the characters incorporated in the groups of characters, with or without spacing, and at the typing cadence of the syllabic typing. A reader, of well-known type, reads in the buffer storage and controls the impression in alphabetic print, that is, letter by letter, the spaces being separated, but at the maximal cadence at which the non-syllabic printing mechanism can function.

In this form of embodiment, the printing mechanism can be of any type:- for example, the type support can be made up of type bars, of a cylinder or of a sphere. The buffer storage unit being made up of elements already well-known in themselves, it is not necessary to describe them in detail here. The same goes for the printing mechanism. What is characteristic is the combination of the described syllabic keyboard with a storage unit which receives the syllabic elements and with a reading and printing mechanism which is not syllabic.

The nature of the various buffer storage units which can be used is described later.

Cs Mbp Ia.- Same combination as Cs M Ia but the buffer storage unit comprises a punched tape which constitutes a storage medium. The punched tape can be conserved and stored to control the same printing mechanism or other printing mechanisms, of which the structure may be different, afterwards.

Cs Mm Ia.- This is the combination Cs M Ia, when the buffer storage unit is magnetic. An additional advantage is the fact that the same storage medium can be used a number of times.

Cs Mbm Ia.- Same combination as Cs Mm Ia but with the precision that the storage medium is made up of a magnetic tape. The same device enables the use of a continuous tape, or a looped endless tape.

Cs M Ia M.- Same combination as Cs M Ia but, in addition to the buffer storage unit, the mechanism is fitted with another storage device the storage medium of which is continuous and which will serve to re-operate the same printing mechanism or another similar, or different mechanism afterwards.

Cs Mm Ia Mp.- Same combination as Cs M Ia M but in which the first storage is magnetic and where the second storage device comprises a perforated storage medium.

Cs Mm Ia Mbp.- Same combination as Cs Mm Ia Mp but with the precision that the second storage medium is made up of a punched tape. In this case, the device which ensures the advance of the tape can be identical or similar to the one which is usually used with a normal electric typewriter, connected to a recording devide which comprises a punched storage medium. It is the pulses transmitted by the buffer storage unit which controls in parallel the non-syllabic printing mechanism and the recording by punching. The punched storage medium enables the future controlling of the same printing mechanism or another one, at a distance.

Cs Me Ia.- Same combination as Cs M Ia but in the case where the buffer storage unit comprises an electronic memory medium.

This form of buffer storage unit has the following advantages: it requires no moving mechanical components, its volume is very small and alphabetic printing can begin as soon as the keyboard is struck. The operator can thus see what is being printed with no delay.

Cs Mm.- Combination of a syllabic keyboard with a magnetic storage unit. In all these cases, the machine can be without a printing mechanism. The storage medium serving to control a printing mechanism afterwards. This mechanism can be identical or similar, to the one of a syllabic typewriter, for example, the one shown in FIG. 12, or to one of an alphabetic, non syllabic typewriter. It can also be totally different. It can be a printing machine of the type used in the graphic arts; for example a linotype (Trade Mark), or a photoprinting device.

Cs Mbm.- Same combination as Cs Mm but in the particular case where the storage medium is made up of a magnetic tape. It has been said that in this case, the magnetic tape can advance by jumps of different lengths or by uniform jumps of just one line, the number of tracks in this case being greater.

In this latter case, the jumps can be replaced by a continuous advance of the tape, the reader reading "in passing". This last method is already used with non-syllabic, aliphabetic keyboards.

Cs Mcm.- Combination similar to Cs Mbm but were the magnetic tape is replaced by a magnetic card. A card is more convenient in certain cases where the text is short. This storage support accelerates the selection of a given passage and facilitates filing. The devices for recording and for reading can be identical to those used with a magnetic tape.

Cs Mdm.- Combination includes in Cs Mm but a particular case where the storage medium is made up of one or several magnetic discs. Both faces of the disc can be used successively or simultaneously. The elements which produce the rotation of the discs, the recording and the reading are well-known. One can affect some particular tracks to each one of the groups of characters which have a distinct printing point. In this case the devices for recording and those for reading can be adapted so that the storage can control, at a later date, the printing through a syllabic machine identical, or similar to the one described or through any other syllabic machine which prints, or which controls several characters will or without spaces, to become apparent simultaneously. It is well-known that the devices incorporating a disc storage medium enable a rapid selection of a given part of a recording: for example, recordings of standard paragraphs.

For the various combinations briefly described above, it did not seem useful to describe in detail and to show by drawings the elements of each combination which are already known. What is particularly new is the combination of the syllabic keyboard with these known elements, the syllabic recording enabling, in certain cases, syllabic printing.

SYLLABIC KEYBOARD WITH TWO CASE POSITIONS

When the alphabetic (non-syllabic) printing mechanism which is controlled by a syllabic keyboard comprises only two case positions, the syllabic keyboard may have only two case positions, that is two characters per key. For example, if the printing mechanism is of a type with type bars, each key corresponds to two characters located on the same type bar. If this mechanism is with a printing sphere they are the two characters which are diametrically opposed on this sphere. It is known that in typewriters with a printing sphere, each of the two positions corresponds to one of the two hemispheres of this sphere.

Figure 15:
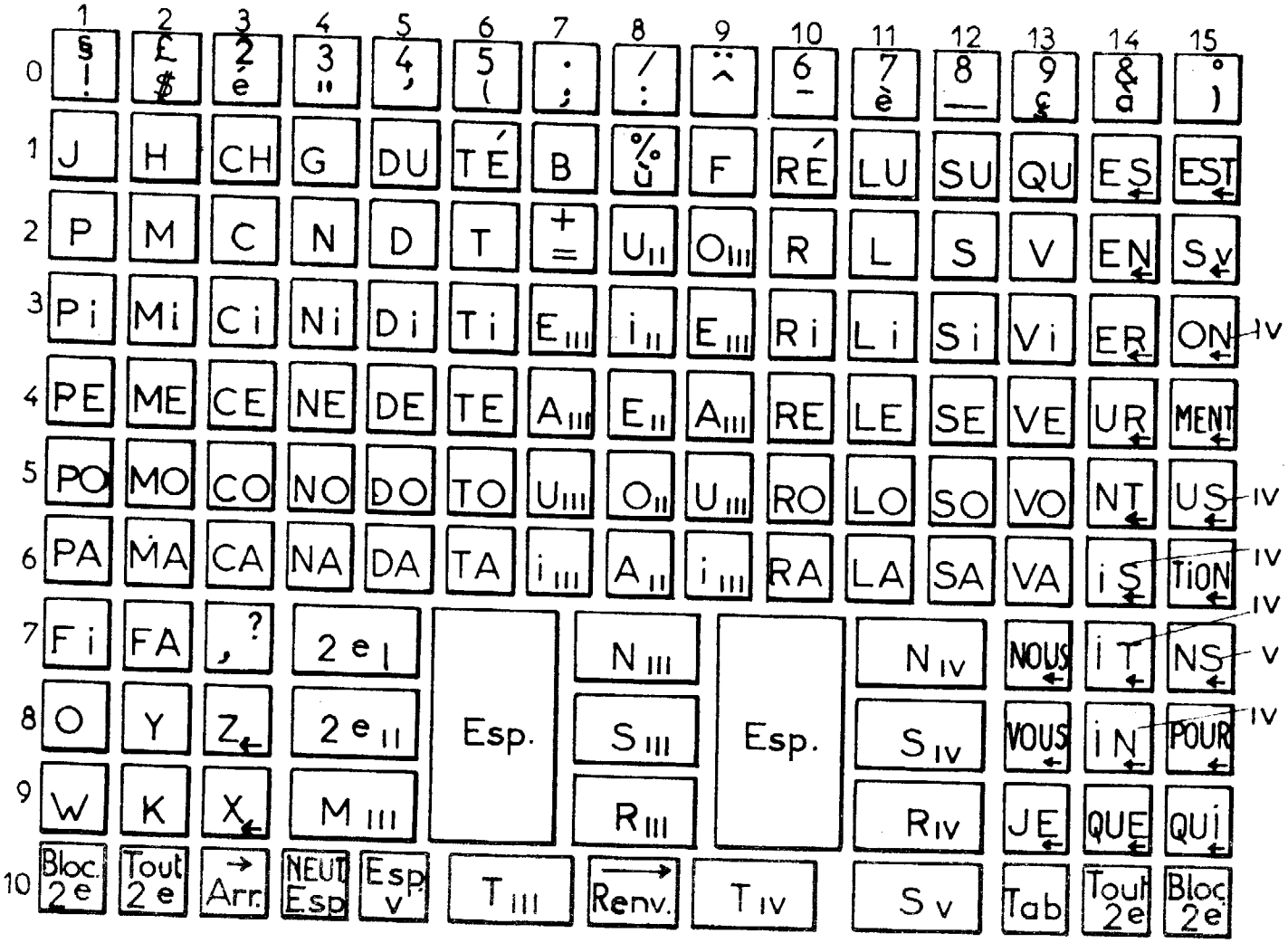
FIG. 15. Example of a syllabic keyboard with two case positions, designed for the French language.

As an example, the keyboard shown in FIG. 15 is a transposition of the keyboard shown in FIG. 7 with 3 positions to a keyboard with 2 positions. The only major differences between these two keyboards is that the characters which in FIG. 7 are in position 3 are attributed to the keys in a supplementary row which, in FIG. 15 is numbered 0 (zero). Some are therefore placed in case position 1 and the others in case position 2. Note that the layout of the keys in this row is almost the same as in the first row of the keyboard, called "Universal", of usual non-syllabic typewriters.

What I claim is:

1. A syllabic-keyboard controlled device, in which the keyboard comprises : a plurality of keys (FIGS. 7 and 8) which can be simultaneously depressed and which are arranged in rows and columns, certain of said keys simultaneously controlling a plurality of characters belonging to character groups which each correspond to a distinct printing point; certain of said keys which each control simultaneously a character of a first character group an a character of second character group being disposed and arranged in a matrix; a central key in certain rows of keys controlling only the vowel of the second character group which corresponds to the other keys of the matrix in the same row; the keyboard comprising the following improvements:

in several rows of the matrix, two keys adjacent the central key control a character of a third character group which is the same for the two keys; two space keys the width of which is about that of two columns of the matrix and the length of which is at least equal to that of three rows of the matrix; said space keys being disposed forwardly of said matrix and being spaced laterally from one another on opposite sides of the center of the keyboard and three sets of thumb-operated keys which are elongate in the sense of the rows of the matrix, the width of said thumb-operated keys being approximately twice that of a matrix key, each of said sets comprising three keys situated respectively in three rows, one set of three keys being between the two space keys, a second set to the left of the left space key, and the third set at the right of the right space key, all of these thumb-operated keys adjacent to the space keys being in the same plane as said space keys, so that a thumb of an operator can depress each of these thumb-operated keys, either alone or at the same time as an adjacent space key.

2. A device as claimed in claim 1, in which the keyboard comprises a central column of keys each of which is higher than the two adjacent keys in the same row (FIG. 9), these two adjacent keys being higher than the following keys in the same row situated further to the right and left respectively, each of these differences in level being slightly greater than the stroke of the keys.

3. A device as claimed in claim 2, the keyboard of which comprises electric switches actuated by said keys and further comprising the following improvements:

in several rows (FIGS. 7 and 8), the central key controls the vowel of the second character group which corresponds to the other keys of the matrix in the same row; in several rows, the two keys adjacent the central key control a vowel of the third character group which is the same for the two keys and which statistically is often associated with the vowel of the second character group controlled by the keys in the same row of the matrix; the thumb-operated keys situated between the two space keys each control one of the statistically most frequent consonants of the third character group, the other consonants of the third character group and those of the fourth character group being each assigned to one of the other thumb-operated keys; character combinations corresponding to frequent word-endings aare assigned to keys in the two columns nearest the right, these keys being provided with an automatic space; and certain character combinations which each correspond to an entire word are assigned to keys which are situated in the front right-hand corner of the keyboard and provided with an automatic space.

4. A device as claimed in claim 1, the keyboard of which comprises electric switches actuated by said keys (FIG. 13) and in which, the assignment of characters to the keys of said keyboard having been determined for a particular language (FIG. 7), a series of supplementary keys (FIG. 14) are provided which each control the printing of an association of characters frequently encountered in a second language.

5. A device as claimed in claim 1, the keyboard of which comprises electric switches actuated by said keys, and including a commutator (987 FIG. 12*a*) though which pass circuits corresponding to certain keys and by means of which the characters controlled by these keys may be altered to adapt the keyboard to a particular class of work.

6. A device as claimed in claim 1, the keyboard of which comprises electric switches actuated by said keys and comprises certain keys which each control simultaneously up to as many characters as there are character groups each corresponding to a distinct printing point, plus an automatic space ("tions." FIG. 10).

7. A syllabic keyboard controlled device (FIGS. 5*a*–5*c*), the keyboard of which comprises a plurality of character keys arranged in rows and columns, certain of said keys each controlling a plurality of characters belonging to different character groups which each correspond to a distinct printing point; certain keys being disposed and arranged in a matrix comprising several rows and several columns, the device comprising the following improvements:

the character keys are each mounted on a vertically displaceable rod (FIG. 3) the lower end of which has an upper knife edge (724) and a lower knife edge (725), the upper knife edges, in rest position, are situated in angular notches (730) of a fixed plate (729 FIGS. 4, 5), the lower knife edges, in rest position, are each situated in angular notches (752) of parts that the corresponding key controls, certain keys each controlling up to three characters, the lower knife edges corresponding to keys belonging to the matrix in a given column overlie an articulated parallelogram (FIGS. 4 and 5*b*) which corresponds to this column and which each knife edge can control separately, each of these articulated parallelograms comprises two bell-crank levers (762, 763), the upper horizontal end portions of which are linked by an upper connecting rod formed with angular notches in which the lower knife edges engage; and lower end portions are linked by a lower connecting rod, so that the upper connecting rod can only move parallel to itself, the keyboard further including a transverse countermotion device (748, 760 FIG. 5) for each row of the matrix, the lower knife edges corresponding to keys situated in this row overlying and acting on the transverse countermotion device at the same time as on one of the articulated parallelograms, so that each key of the matrix controls simultaneously the printing of a character which corresponds to several keys of the column of keys and of a character which corresponds to several keys of the row, the axes of the transverse countermotion devices being in the same plane as the fixed axes of the articulated parallelograms.

8. A device as claimed in claim 7 further comprising a motor element, electromagnets (901, 902 FIG. 4) which each produce an engagement of a transmission part with the motor element (771) to cause a printing of a selected character, certain of said electromagnets being connected to a switch (718) arranged in the path of movement of one of the mobile elements belonging to one of the articulated parallelograms each set in motion by several keys of the same matrix column, certain others of these electromagnets being each connected to a switch (984) arranged on the path of movement of one of the mobile elements belonging to one of the transverse countermotion devices each set in movement by several keys of the same row of the matrix, so that each key situated above the intersection of one of these parallelograms and of one of these transverse countermotion devices controls simultaneously the energization of two electromagnets corresponding to two characters.

9. A keyboard controlled device comprising: a syllabic-keyboard comprising electric switches and a space key and character keys certain of which can be depressed simultaneously; the device comprising a spacing device and type-bars belonging to different character groups which each correspond to a distinct printing point, electromagnets each of which engages a transmission element with a motor element, some of said transmitting elements transmitting movement to type bars and others to the spacing device, the device comprising the following improvements:

several of these electromagnets are connected with the same keyboard switch (FIGS. 7, 8, 11, 10), so that depression of a single key controls simultaneously the printing of up to five characters plus an automatic space, certain of these electromagnets being each connected to several keyboard switches, so that several switches each control the printing of the same character.

10. A device as claimed in claim 9 in which certain of the electromagnets which each engage a transmission element with the motor element to transmit movement of a type-bar of a first character group are each connected to several switches of the same keyboard column, and certain of the electromagnets which each engage a transmission element to transmit the movement to a type-bar of a second character group are each connected to several switches of the same keyboard row, so that certain keys each produce simultaneously the printing of a character of the first character group which corresponds to the keyboard column and of a character of the second character group which corresponds to the keyboard row, this combination thus constituting a matrix.

11. A device as claimed in claim 9, in which certain of the keyboard switches (FIG. 8) each close two circuits one of which controls the printing of a character of the first character group and includes a conductor parallel with the keyboard columns, the other circuit controlling the printing of a character of the second character group and comprising a conductor parallel with the keyboard rows, all the circuits closed by switches of the keyboard being supplied by a common conductor having branches which are parallel with the keyboard rows, this supply circuit and the circuits which control the characters of the second character group being printed (FIG. 11) on the same face of a support which also supports the keyboard switches (FIG. 13), the circuits which each control the printing of a character of the first character group and each corresponding to several keys of a same column constituting a second network.

* * * * *